US012753604B2

(12) United States Patent
Bielkov et al.

(10) Patent No.: US 12,753,604 B2
(45) Date of Patent: Oct. 6, 2026

(54) ELONGATED CEILING GRID MEMBER AND CEILING GRID ASSEMBLY INCLUDING A PLURALITY OF THE ELONGATED CEILING GRID MEMBER

(71) Applicant: TATE ACCESS FLOORS, INC., Jessup, MD (US)

(72) Inventors: Maksym Bielkov, Bray (IE); James Denis Maher, Dublin (IE); Christopher Buss, Washington, DC (US); Lucas Michael Fox, Baltimore, MD (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 108 days.

(21) Appl. No.: 18/802,781

(22) Filed: Aug. 13, 2024

(65) Prior Publication Data

US 2026/0049471 A1 Feb. 19, 2026

(51) Int. Cl.

| | |
|---|---|
| ***E04B 9/06*** | (2006.01) |
| ***E04B 9/10*** | (2006.01) |
| ***E04B 9/12*** | (2006.01) |
| ***E04B 9/18*** | (2006.01) |
| ***E04B 9/24*** | (2006.01) |
| ***E04B 9/36*** | (2006.01) |
| *E04B 9/00* | (2006.01) |

(52) U.S. Cl.

CPC ..... *E04B 9/064* (2013.01); *E04B 9/10* (2013.01); *E04B 9/127* (2013.01); *E04B 9/183* (2013.01); *E04B 9/242* (2013.01); *E04B 9/36* (2013.01); *E04B 9/366* (2013.01); *E04B 9/006* (2013.01)

(58) Field of Classification Search

CPC . E04B 9/064; E04B 9/10; E04B 9/127; E04B 9/242; E04B 9/006

USPC ..... 52/79.5

See application file for complete search history.

(56) References Cited

U.S. PATENT DOCUMENTS 4,873,809 A * 10/1989 Paul ..... E04B 9/242 52/506.07
5,313,759 A * 5/1994 Chase, III ..... E04B 9/18 52/39
8,881,481 B2 * 11/2014 Myers ..... H01B 17/58 52/712

(Continued)

OTHER PUBLICATIONS

Jan. 30, 2026 Search Report issued in European Patent Application No. 25194888.1.

(Continued)

*Primary Examiner* — Brent W Herring
(74) *Attorney, Agent, or Firm* — Oliff PLC

(57) ABSTRACT

An elongated ceiling grid member including (1) an upper portion having spaced upper portion side walls (a) threaded to receive and retain a first threaded member and (b) with lowermost edges, (2) a lower portion having spaced lower portion side walls (a) configured to receive and retain a second threaded member and (b) with uppermost edges, and (3) a middle portion that (a) connects the lowermost edges of the upper portion side walls and the uppermost edges of the lower portion side walls and (b) includes a pair of middle portion side walls that curve inwardly from the lowermost edges of the upper portion side walls and the uppermost edges of the lower portion side walls to contact each other between those edges.

14 Claims, 18 Drawing Sheets

(56) References Cited

U.S. PATENT DOCUMENTS

| | | | | |
|---|---|---|---|---|
| 9,771,718 | B1 * | 9/2017 | Curtin | E04C 3/07 |
| 10,590,649 | B1 * | 3/2020 | Morrison | E04B 9/20 |
| D950,776 | S * | 5/2022 | Shaffer | D25/126 |
| D989,990 | S * | 6/2023 | Shaffer | D25/133 |
| 11,814,840 | B2 * | 11/2023 | Frame | E04B 9/064 |
| D1,029,297 | S * | 5/2024 | Koval | D25/164 |
| 2022/0106788 | A1 * | 4/2022 | Laydera-Collins | E04B 9/242 |
| 2022/0316209 | A1 | 10/2022 | Kabatsi et al. | |
| 2023/0332403 | A1 | 10/2023 | Frame et al. | |

OTHER PUBLICATIONS

Apr. 28, 2026 Search Report issued in Moroccan Patent Application No. 72341.

* cited by examiner

ELONGATED CEILING GRID MEMBER AND CEILING GRID ASSEMBLY INCLUDING A PLURALITY OF THE ELONGATED CEILING GRID MEMBER

FIELD OF THE INVENTION

This invention relates to elongated ceiling grid members and to ceiling grid assemblies that include the elongated ceiling grid members and are attached to and suspended from ceilings of rooms and other building spaces, such as office spaces, storage areas, and data centers, to function as the framework for directly and/or indirectly supporting other structural members and/or room or building accessories. In particular, this invention relates to elongated ceiling grid members (1) that can be connected on their ends to form a ceiling grid assembly consisting of parallel and perpendicular rows of the elongated ceiling grid members and (2) to which the other structural members and/or room or building accessories can be attached.

BACKGROUND OF THE INVENTION

Ceiling grid assemblies comprised of a plurality of elongated ceiling grid members connected on their ends to form parallel and perpendicular rows of the elongated ceiling grid members have been in use for decades. Those ceiling grid assemblies are usually directly attached to and suspended from the structure comprising the ceiling of a room or other building space, such as a concrete slab. The elongated ceiling grid members of those ceiling grid assemblies directly or indirectly support other structural members and room or building accessories, such as light fixtures, HVAC conduits, sprinkler systems, etc., in the rooms or other building spaces in which they are installed.

In many applications, those elongated ceiling grid members and ceiling grid assemblies must support ever increasing loads, weight-wise. That is, rooms and other building spaces that include those elongated ceiling grid members and ceiling grid assemblies have an ever increasing number of structural members and room or building accessories to be supported by the elongated ceiling grid members and ceiling grid assemblies in those rooms and other building spaces, which ever increasing number of structural members and room or building accessories increases the load on those elongated ceiling grid members and ceiling grid assemblies. Thus, there is a need in the art for elongated ceiling grid members and ceiling grid assemblies that have increased strength to adequately support those increased loads.

In addition, those elongated ceiling grid members often support ceiling tiles or similar structures. It is desirable that the ceiling grid assemblies comprised of the elongated ceiling grid members include apparatus to retain the ceiling tiles or similar structures in place, even when large forces are pushing up on the ceiling tiles, while allowing relatively easy removal or re-positioning of those ceiling tiles or similar structures. Thus, there is a need in the art for apparatus that interacts with the elongated ceiling grid members to "hold" the ceiling tiles or similar structures in place, while allowing relatively easy removal or re-positioning of those ceiling tiles or similar structures.

This invention addresses those needs, as well as other needs that are readily apparent to those of skill in the art.

SUMMARY OF THE INVENTION

The elongated ceiling grid members of this invention have a longitudinal axis in a longitudinal direction. Some embodiments of the elongated ceiling grid members include (1) an upper portion having spaced upper portion side walls (a) extending in parallel in the longitudinal direction, (b) threaded to threadably receive and retain a first threaded member and (c) including lowermost edges extending in the longitudinal direction, (2) a lower portion having spaced lower portion side walls (a) extending in the longitudinal direction, (b) configured to receive and retain a second threaded member and (c) including uppermost edges extending in the longitudinal direction, and (3) a middle portion that (a) connects the lowermost edges of the upper portion side walls and the uppermost edges of the lower portion side walls and (b) includes a pair of middle portion side walls extending in the longitudinal direction. Each of the pair of middle portion side walls, from top to bottom when viewed along the longitudinal axis, may (a) begin at a different one of the lowermost edges of the upper portion side walls, (b) curve toward the other of the pair of middle portion side walls to join the other of the pair of middle portion side walls and (c) curve away from the other of the pair of middle portion side walls from the joinder with the other of the pair of middle portion side walls to end at one of the uppermost edges of the lower portion side walls.

In other embodiments of this invention, the upper portion includes a bottom wall that extends between and connects the upper portion side walls at or near their lowermost edges, the lower portion includes a top wall that extends between and connects the lower portion side walls at or near their uppermost edges and the middle portion side walls, from top to bottom, begin at the bottom wall and end at the top wall.

In yet other embodiments of this invention, each of the pair of middle portion side walls may include a finger configured to engage a ceiling tile hold down clip. That finger may extend outwardly from the pair of middle portion side walls.

Further embodiments of this invention include an elongated ceiling grid member and ceiling tile hold down clip assembly. The elongated ceiling grid member of that assembly may be as described above and also include lowermost flanges extending in the longitudinal direction from and perpendicular to the pair of lower portion side walls. Those lowermost flanges may be configured to support a ceiling tile. The ceiling tile hold down clip of those embodiments may be engagement with the finger of the elongated ceiling grid member and configured to engage the ceiling tile supported by the lowermost flanges. The ceiling tile hold down clip of those embodiments may also include a ceiling tile hold down clip top wall above and spanning the upper portion side walls of the elongated ceiling grid member, ceiling tile hold down clip side walls extending downward from the ceiling tile hold down clip top wall and abutting exterior surfaces of those upper portion side walls, outwardly extending walls that extend outwardly and downwardly from the ceiling tile hold down clip side walls and a ceiling tile hold down clip finger that extends inwardly from the outwardly extending walls and engages the finger of the middle portion of the elongated ceiling grid member. The hold down clip may be comprised of a spring steel.

Yet other embodiments of this invention include an elongated ceiling grid member and connector assembly. That assembly may include at least two of the elongated ceiling grid member described above and a connector (a) bridging the at least two of the elongated ceiling grid member, (b) having a connector top wall with at least two orifices configured to receive a threaded member, (c) having connector side walls extending downward from the connector top wall toward the upper portion side walls of the at least two of the elongated ceiling grid member and (d) tabs extending from the connector side walls on both sides of the upper portion side walls and configured to engage and retain the upper portion side walls.

DETAILED DESCRIPTION OF EMBODIMENTS

Figure 2:
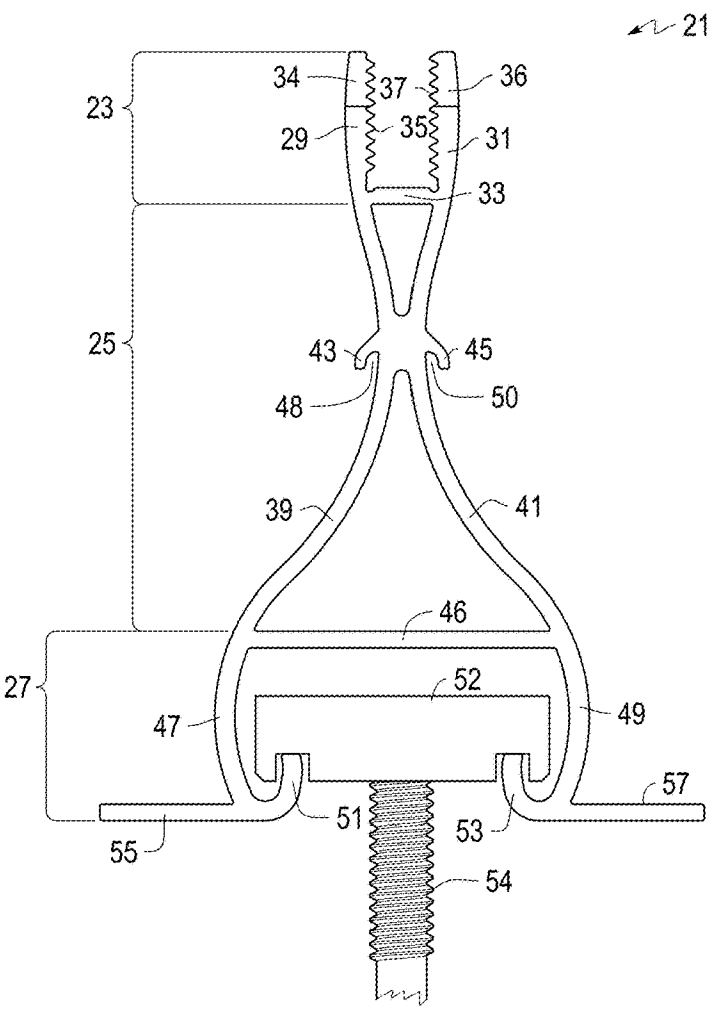
FIG. 2 is a front, elevation view of the elongated ceiling grid member illustrated in FIG. 1.
Figure 1:
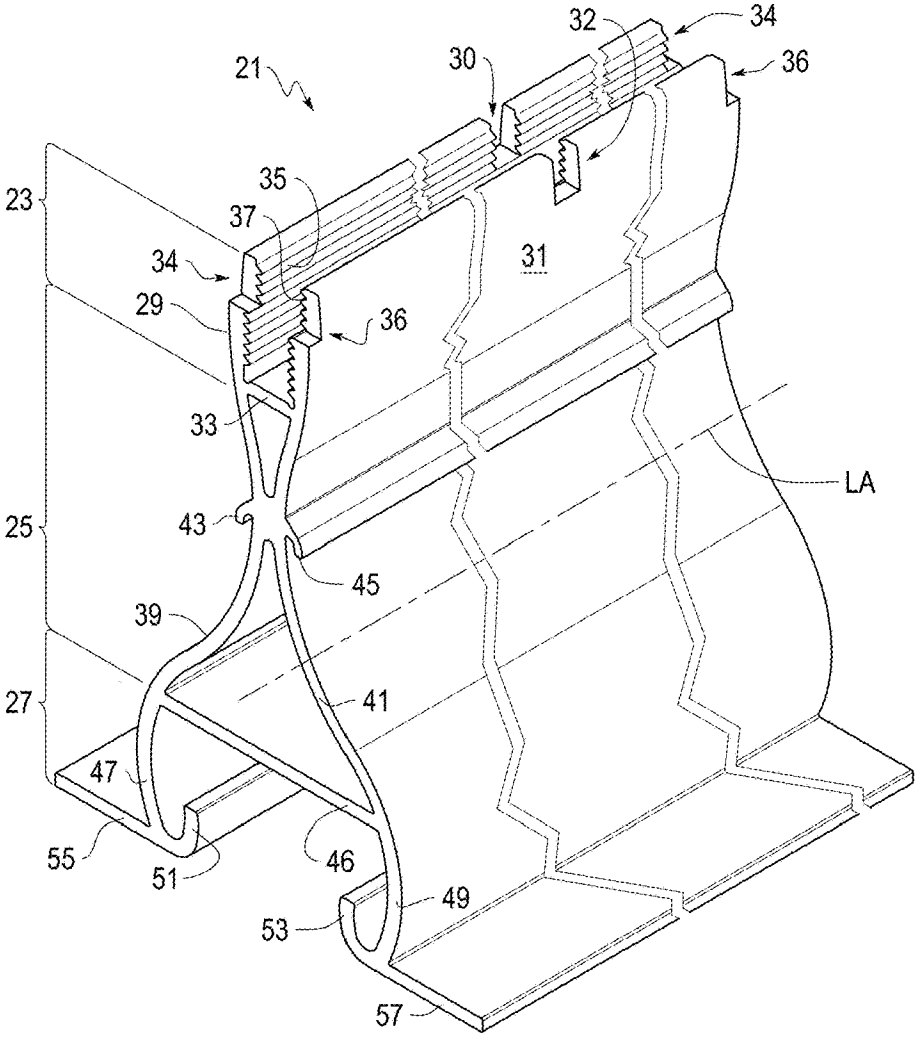
FIG. 1 is a side perspective view of an elongated ceiling grid member of one embodiment of this invention.
Figure 2A:
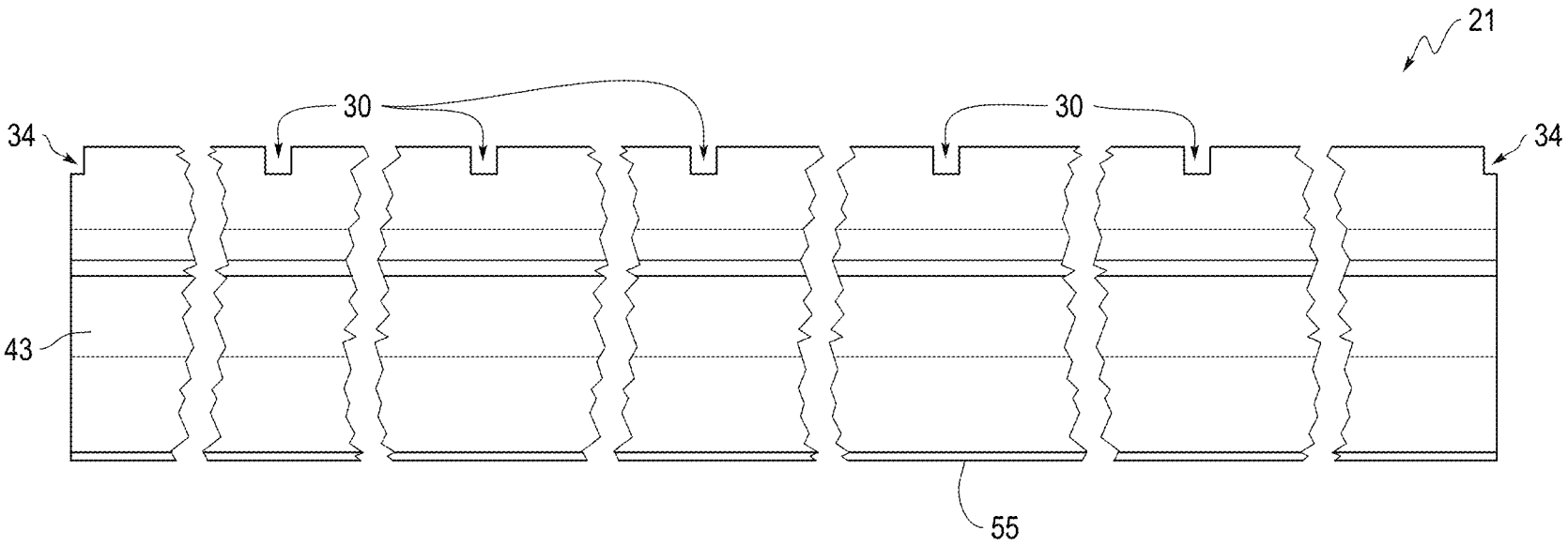
FIG. 2A is a side, elevation view of the elongated ceiling grid member illustrated in FIGS. 1 and 2.

As stated, one embodiment of an elongated ceiling grid member of this invention is illustrated in at least FIGS. 1, 2 and 2A, elongated ceiling grid member 21.

Elongated ceiling grid member 21 has longitudinal axis LA along its length in a longitudinal direction and includes, from top to bottom, upper portion 23, middle portion 25 and lower portion 27.

Upper portion 23 includes side wall 29, side wall 31 and bottom wall 33. In this embodiment of the invention, side walls 29 and 31 are parallel. Bottom wall 33 extends between and connects side wall 29 and side wall 31, at or near their lowermost edges, as shown in FIGS. 1 and 2.

Side wall 29 includes internal threads 35, notches 30 and notches 34 and side wall 31 includes internal threads 37, notches 32 and notches 36.

Internal threads 35 and internal threads 37 are on parallel vertical surfaces and offset vertically so that a threaded member can be threadably received and retained between internal threads 35 and internal threads 37, as discussed below and illustrated in FIGS. 11, 12, 20B and 21.

In this embodiment, notches 30, 32, 34 and 36 are designed to receive and retain protrusions from connecting members that connect two or more of elongated ceiling grid member 21, as discussed below.

While, in this embodiment of the invention, upper portion 23 includes parallel side walls 29 and 31 with internal threads, the upper portions of the elongated ceiling grid members of other embodiments of this invention may include other structure than threaded parallel walls that can receive and retain a threaded or other member suspended from a ceiling. Also, the elongated ceiling grid members of other embodiments may not include any notches in the side walls of their upper portions.

Middle portion 25 includes side wall 39, side wall 41, finger or tab 43 and finger or tab 45.

In this embodiment of the invention, when viewed along the longitudinal axis and as shown in FIGS. 1 and 2, side walls 39 and 41 begin at bottom wall 33, at or near the lowermost edges of side walls 29 and 31, respectively, of upper portion 23 and curve towards each other until they intersect or join. Side walls 39 and 41 then diverge or curve away from each other from that intersection or joinder to top wall 46 of lower portion 27, at or near the uppermost edges of side walls 47 and 49, respectively, of lower portion 27 (top wall 46 and side walls 47 and 49 are further discussed below).

As shown in FIGS. 1 and 2, in this embodiment of the invention, finger or tab 43 extends outwardly from side wall 39 and finger or tab 45 extends outwardly from side wall 41. Finger or tab 43 and finger or tab 45 "point" downwardly to form upwardly extending recess 48 between finger or tab 43 and a portion of side wall 39 and upwardly extending recess 50 between finger or tab 45 and a portion of side wall 41. The function of finger or tab 43 and finger or tab 45 is explained below.

Lower portion 27 includes top wall 46, side wall 47, side wall 49, finger 51, finger 53, bottom flange 55 and bottom flange 57.

In this embodiment of the invention, side wall 47 and side wall 49 extend downwardly from top wall 46. Side wall 47 and 49 "bow" outwardly, as shown in FIGS. 1 and 2. Top wall 46 extends between and connects side walls 47 and 49, at or near their uppermost edges.

Finger 51 extends inwardly and upwardly from the lowermost end of side wall 47. Finger 53 extends inwardly and upwardly from the lowermost end of side wall 49. Fingers 51 and 53 are configured to engage a recess in the bottom surface of a nut, such as nut 52 in FIG. 2, to retain the nut. Threaded member 54 can be attached to nut 52. Threaded member 54 may be a support rod or other structure that supports other room or building space structure, services or apparatus.

Bottom flange 55 extends outwardly from the lowermost edge of side wall 47 and bottom flange 57 extends outwardly from the lowermost edge of side wall 49. In this embodiment, bottom flanges 55 and 57 are perpendicular to side walls 47 and 49. In use, bottom flanges 55 and 57 can support ceiling tiles or other structural members.

While, in this embodiment of the invention, lower portion 27 includes side walls 47 and 49 and fingers 51 and 53 to retain a nut, the lower portion of the elongated ceiling grid members of other embodiments of this invention may include different structure that can retain a threaded or other member.

In this embodiment of the invention, upper portion 23, middle portion 25 and lower portion 27 are integral and can be an extruded aluminum. Thus, for example, side wall 29 of upper portion 23, side wall 39 of middle portion 25 and side wall 47 of lower portion 27 are continuous and side wall 31 of upper portion 23, side wall 41 of middle portion 25 and side wall 49 of lower portion 27 are continuous. In other embodiments of this invention, one or more those portions can be a separate member or separate members joined to the other portions.

Figure 3:
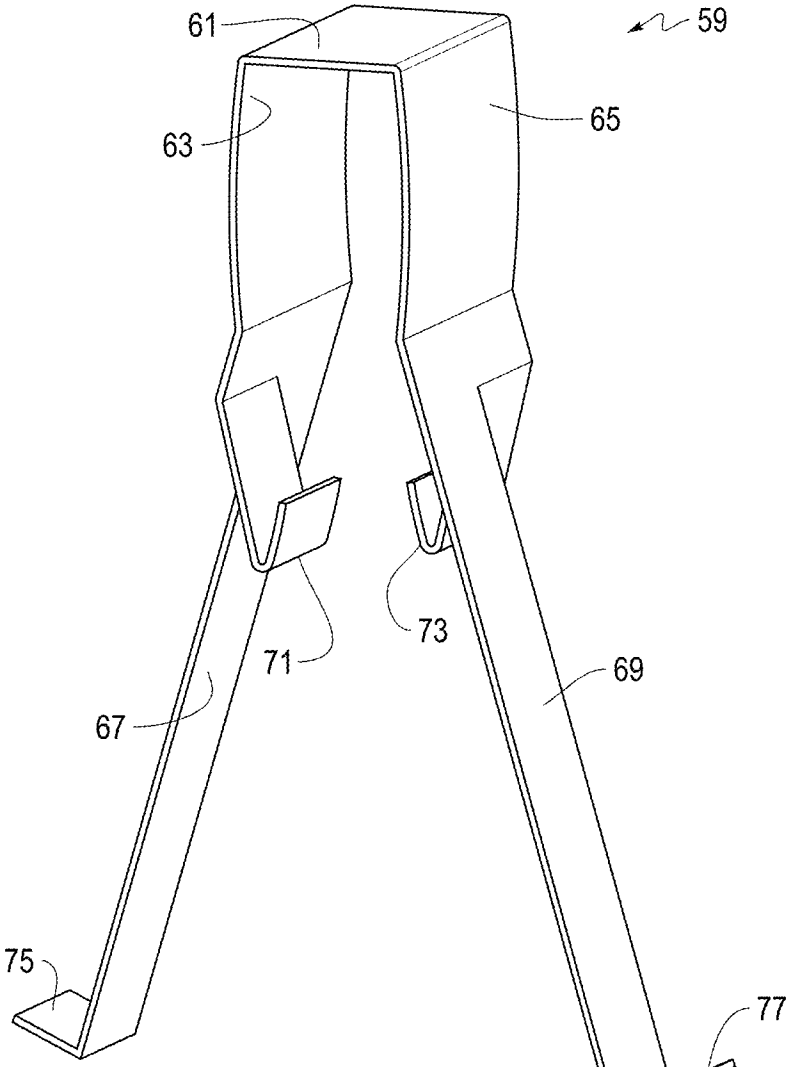
FIG. 3 is a side perspective view of a ceiling tile hold down clip that can be utilized with the elongated ceiling grid member illustrated in FIGS. 1, 2 and 2A.
Figure 5:
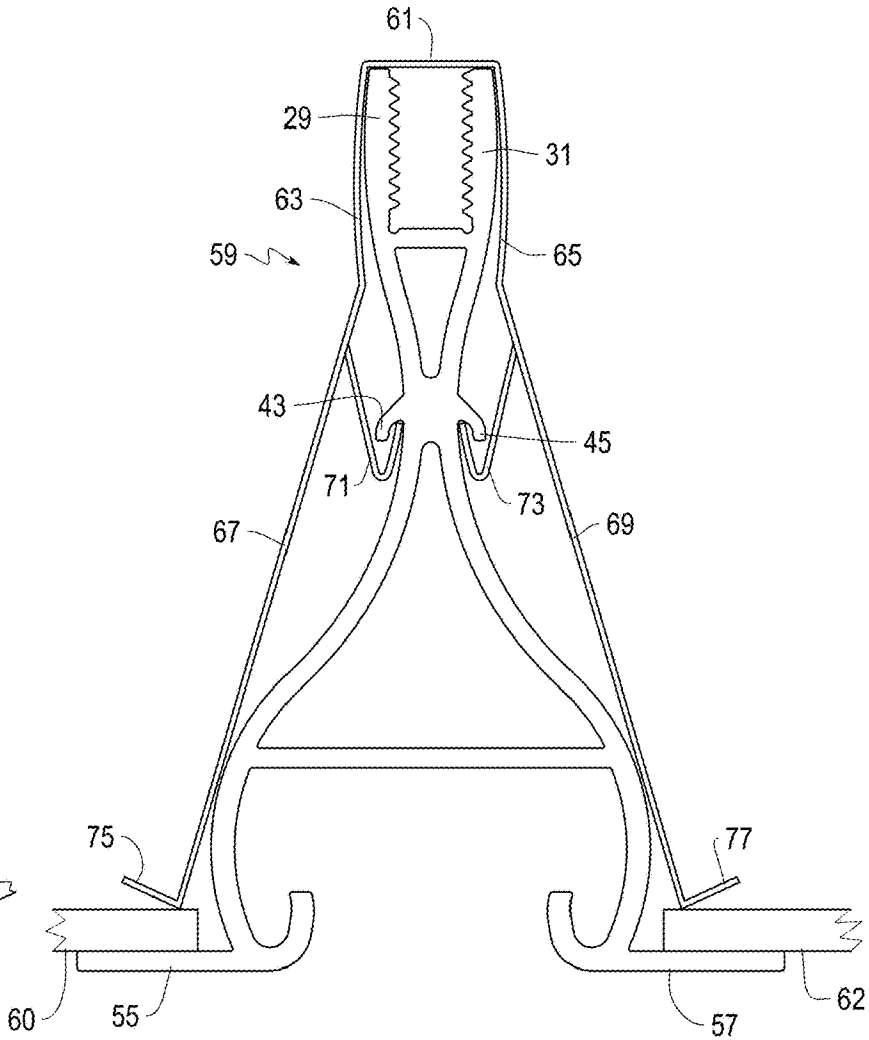
FIG. 5 is a front, elevation view of the assembly, illustrated in FIG. 4, of the ceiling tile hold down clip illustrated in FIG. 3 and the elongated ceiling grid member illustrated in FIGS. 1, 2 and 2A, showing the assembly holding two ceiling tiles in place.
Figure 4:
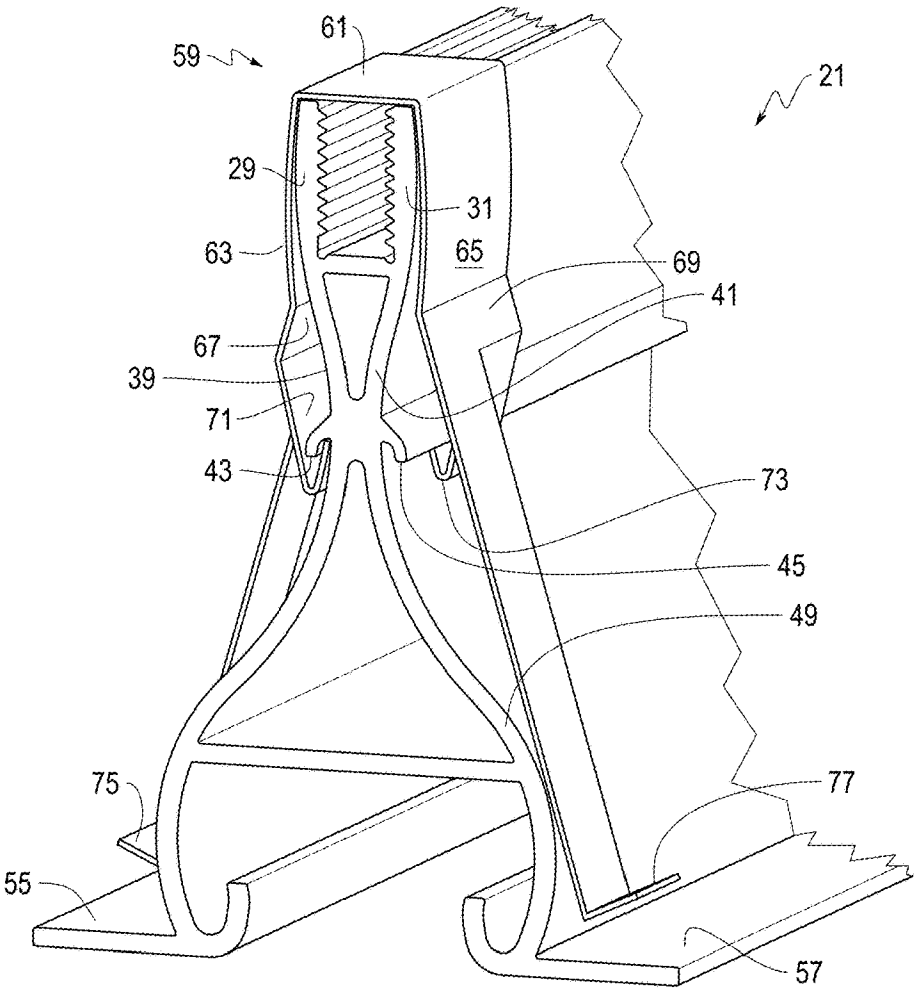
FIG. 4 is a side perspective view of an assembly of the ceiling tile hold down clip illustrated in FIG. 3 and the elongated ceiling grid member illustrated in FIGS. 1, 2 and 2A.

As stated, one embodiment of a ceiling tile hold down clip that can be utilized with elongated ceiling grid member 21 to "hold" a ceiling tile between them is illustrated in FIGS. 3-5, ceiling tile hold down clip 59.

Ceiling tile hold down clip 59 includes top wall 61, upper side wall 63, upper side wall 65, outwardly extending wall 67, outwardly extending wall 69, finger 71, finger 73, bottom flange 75 and bottom flange 77.

Top wall 61 extends between and connects the uppermost edges of upper side walls 63 and 65. When ceiling tile hold down clip 59 is attached to elongated ceiling grid member 21, top wall 61 is above and spans side walls 29 and 31 of elongated ceiling grid member 21, as illustrated in FIGS. 4 and 5.

Upper side walls 63 and 65 extend downward from top wall 61 and are parallel. When ceiling hold down clip 59 is attached to elongated ceiling grid member 21, upper side walls 63 and 65 abut outer surfaces of side walls 29 and 31, respectively, of elongated ceiling grid member 21, as also shown in FIGS. 4 and 5.

Outwardly extending wall 67 extends downwardly and outwardly from upper side wall 63. Outwardly extending wall 69 extends downwardly and outwardly from upper side wall 65.

Finger 71 extends inwardly from outwardly extending wall 67 and is configured to engage finger or tab 43 of elongated ceiling grid member 21, as shown in FIG. 5. Finger 73 extends inwardly from outwardly extending wall 69 and is configured to engage finger or tab 45 of elongated ceiling grid member 21, as also shown in FIG. 5.

Bottom flange 75 extends outwardly from outwardly extending wall 67. Bottom flange 77 extends outwardly from outwardly extending wall 69.

Ceiling tile hold down clip 59 can be made of spring steel and is designed such that ceiling tile hold down clip 59 exerts a downward force on ceiling tiles resting on bottom flanges 55 and 57 of elongated ceiling grid member 21 to retain or "hold" those ceiling tiles in place, as shown in FIG. 5. Specifically, as shown in FIG. 5, ceiling tile 60 "rests" on bottom flange 55 of elongated ceiling grid member 21 and ceiling tile 62 "rests" on bottom flange 57 of elongated ceiling member 21. Bottom flange 75 and bottom flange 77 of ceiling hold down clip 59 resiliently contact the top surfaces of ceiling tiles 60 and 62. Ceiling tiles 60 and 62 can be repositioned or removed by a force that counters the downward force on the ceiling tiles exerted by hold down clip 59.

While, in this embodiment of the invention, ceiling tile hold down clip 59 includes top wall 61, upper side walls 63 and 65, outwardly extending walls 67 and 69, fingers 71 and 73 and bottom flanges 75 and 77, the ceiling tile hold down clips of other embodiments of this invention may include other members as long as the ceiling tile hold down clips are attachable to the elongated ceiling grid member and apply the appropriate "holding" force on ceiling tiles held between the elongated ceiling grid member and the ceiling hold down clips.

As stated, one embodiment of a connector for joining two elongated ceiling grid members 21 end-to-end, in a straight line, straight line connector 121, is illustrated in FIGS. 6-12.

Straight line connector 121 includes side wall 123, side wall 125 and top wall 127. In this embodiment of the invention, top wall 127 is flat. Side walls 123 and 125 extend downwardly from top wall 127.

Figure 11:
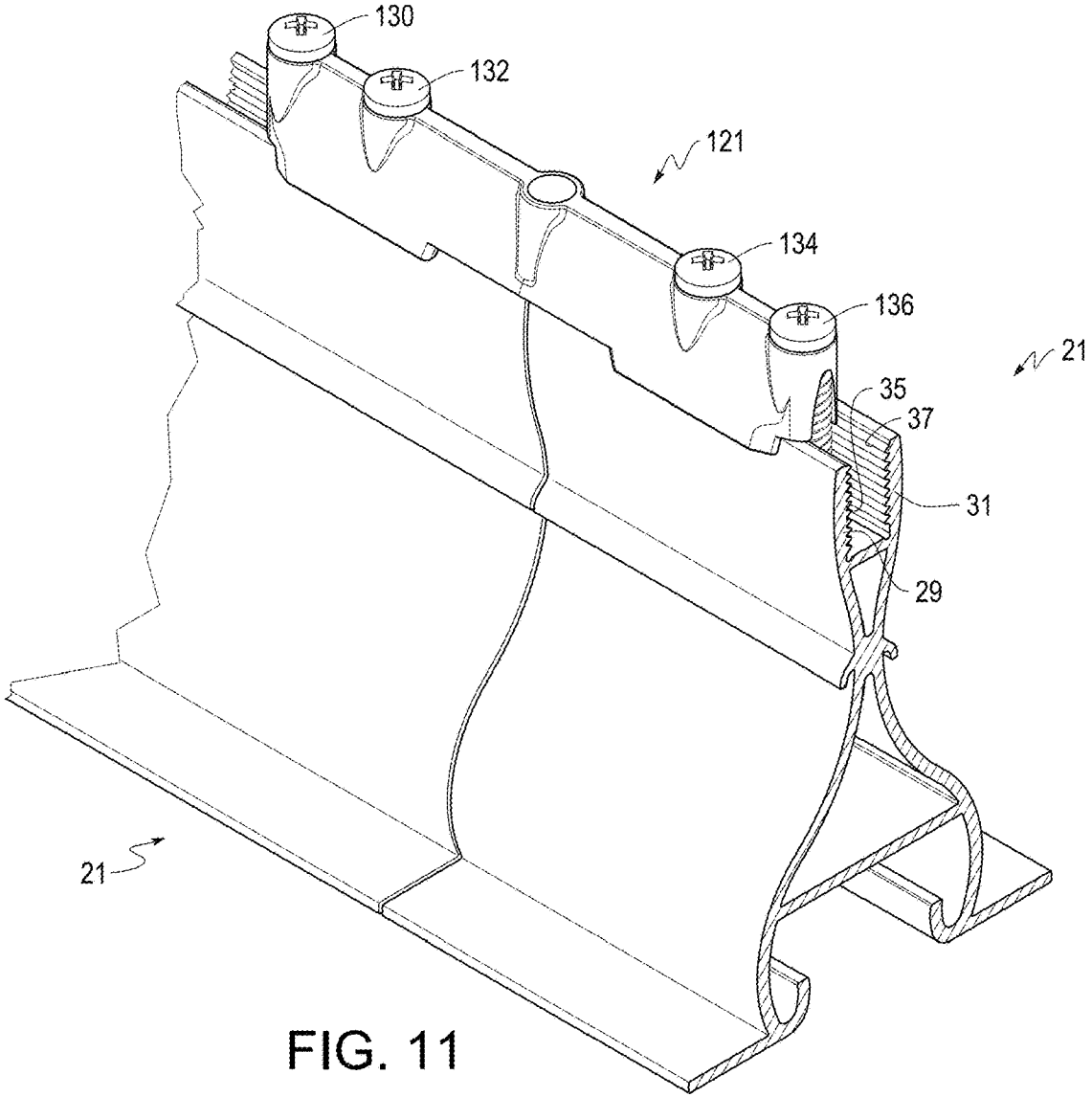
FIG. 11 is a top perspective view of the straight line connector illustrated in FIGS. 7-10 attached to two of the elongated ceiling grid member illustrated in FIGS. 1, 2 and 2A.
Figure 14:
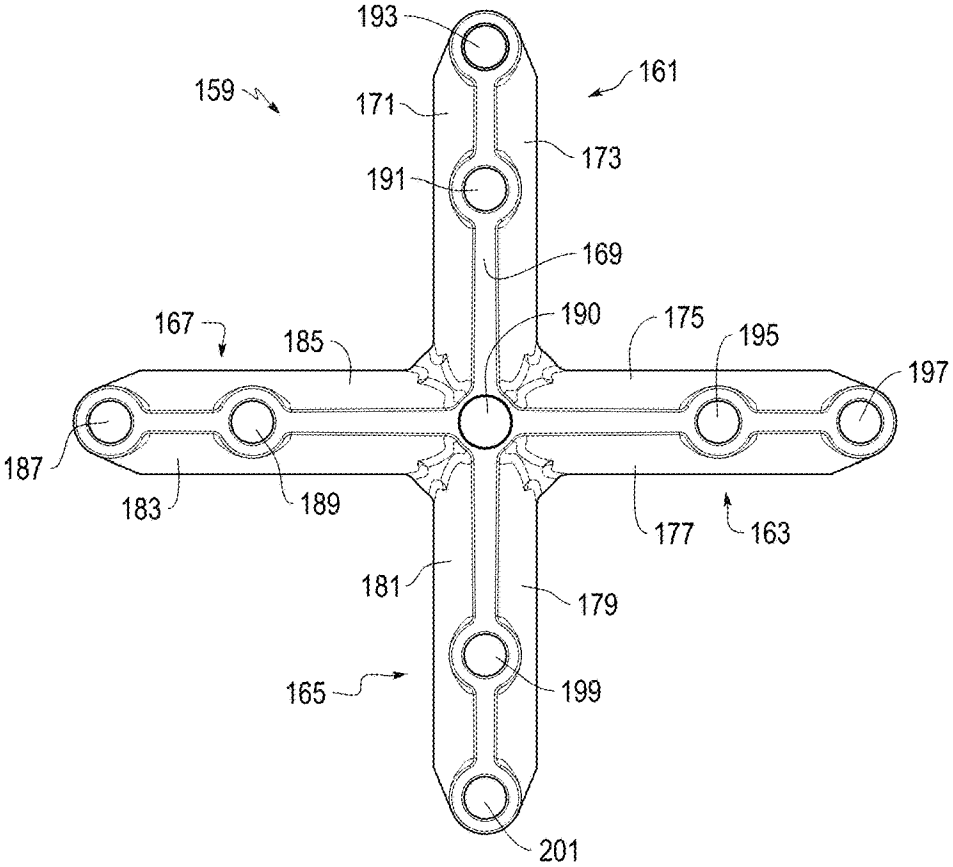
FIG. 14 is a top view of the four arm connector illustrated in FIG. 13.
Figure 13:
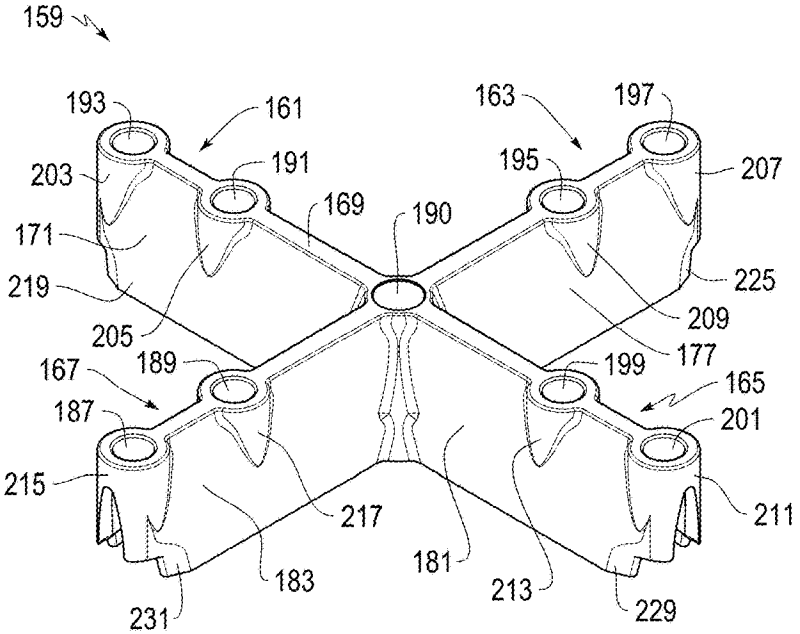
FIG. 13 is a top perspective view of a four arm connector that can connect three or four of the elongated ceiling grid member illustrated in FIGS. 1, 2 and 2A in an X formation.
Figure 15:
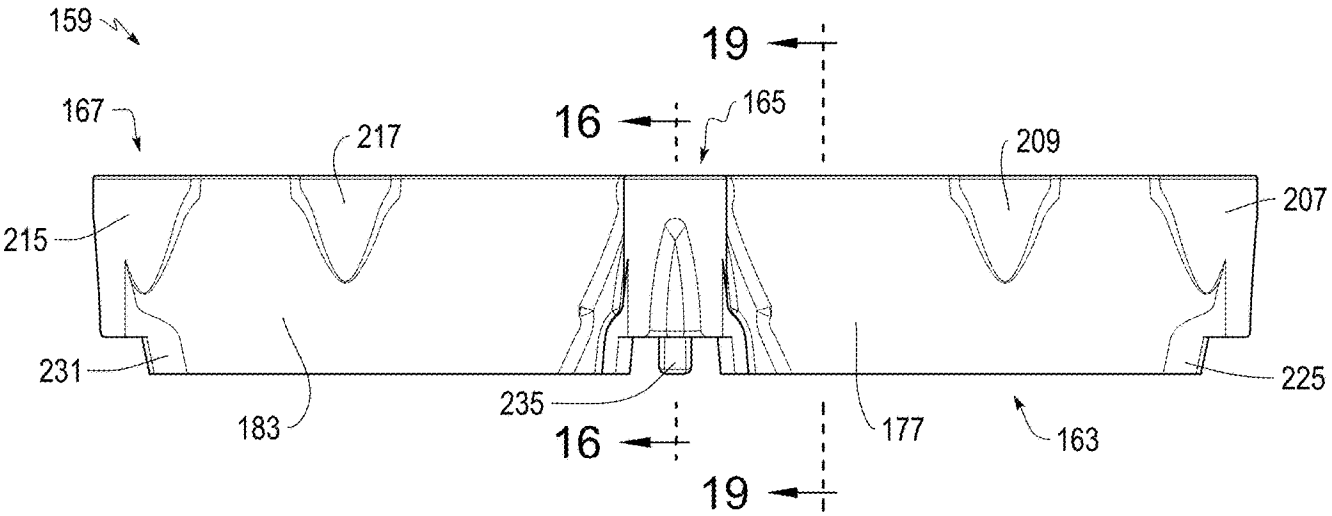
FIG. 15 is a side, elevation view of the four arm connector illustrated in FIGS. 13 and 14.
Figure 16:
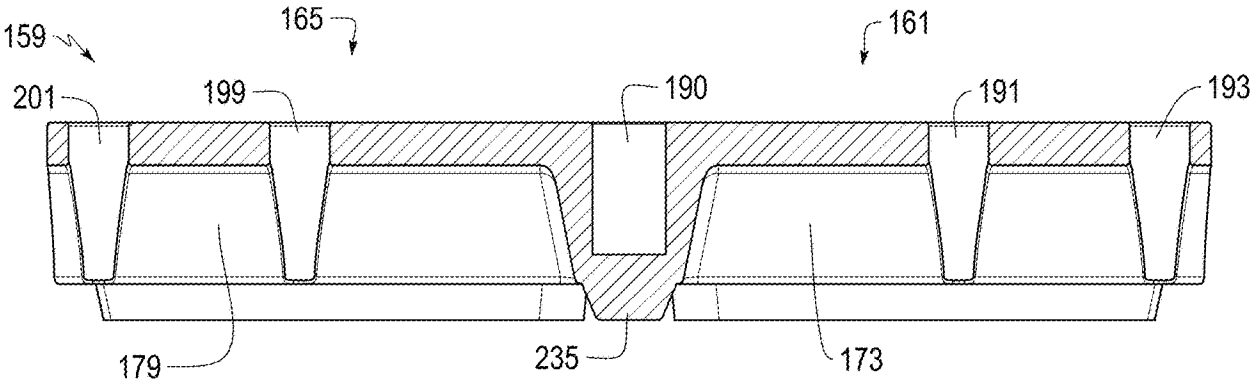
FIG. 16 is a cross-sectional view of the four arm connector illustrated in FIGS. 13-15 taken along line 16-16 of FIG. 15.
Figure 19:
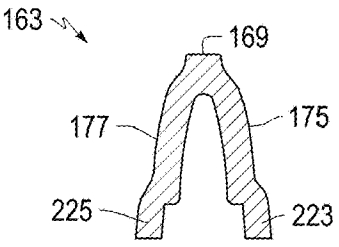
FIG. 19 is a cross-sectional view of the four arm connector illustrated in FIGS. 13-18 taken along line 19-19 of FIG. 15.
Figure 18:
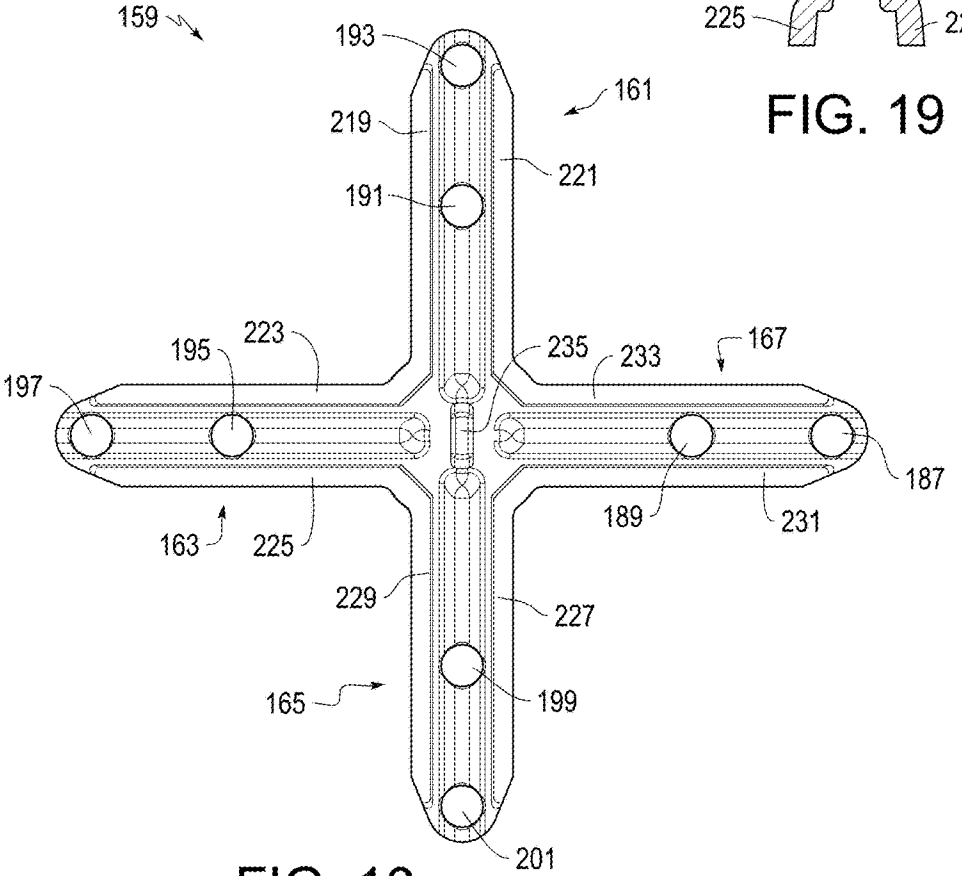
FIG. 18 is a bottom view of the four arm connector illustrated in FIGS. 13-17.
Figure 17:
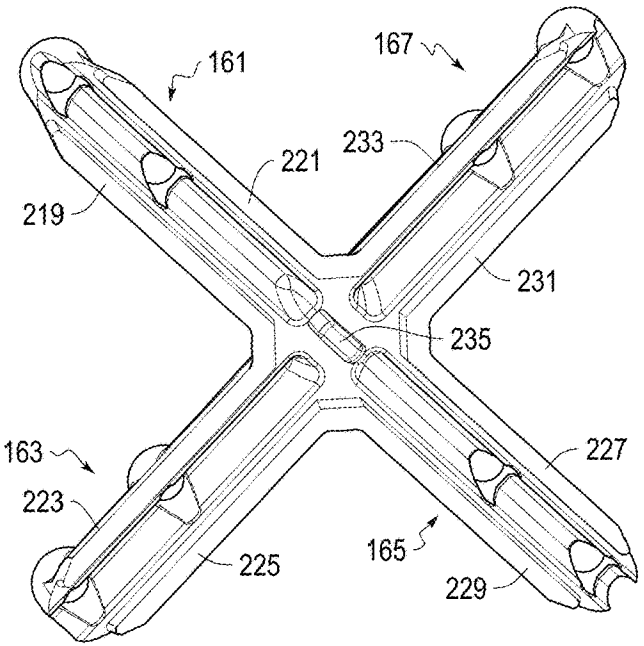
FIG. 17 is a bottom perspective view of the four arm connector illustrated in FIGS. 13-16.

Orifices 129, 131, 133, 135 and 137 are in top wall 127. Orifices 129, 131, 135 and 137 are configured to receive bolts or other fastening members, such as bolts 130, 132, 134 and 136, to attach straight line connector 121 to two elongated ceiling grid members 21, as illustrated in FIGS. 11 and 12. Specifically, bolts 130, 132, 134 and 136 are inserted through orifices 129, 131, 135 and 137, respectively, and threaded portions of those bolts are brought into threaded engagement with internal threads 35 of side wall 29 and internal threads 37 of side wall 31 of upper portions 23 of the two elongated ceiling grid members 21.

Orifice 133 is configured to be machined to receive and retain a structural member, such as a rod, suspended from a ceiling structure.

Figure 6:
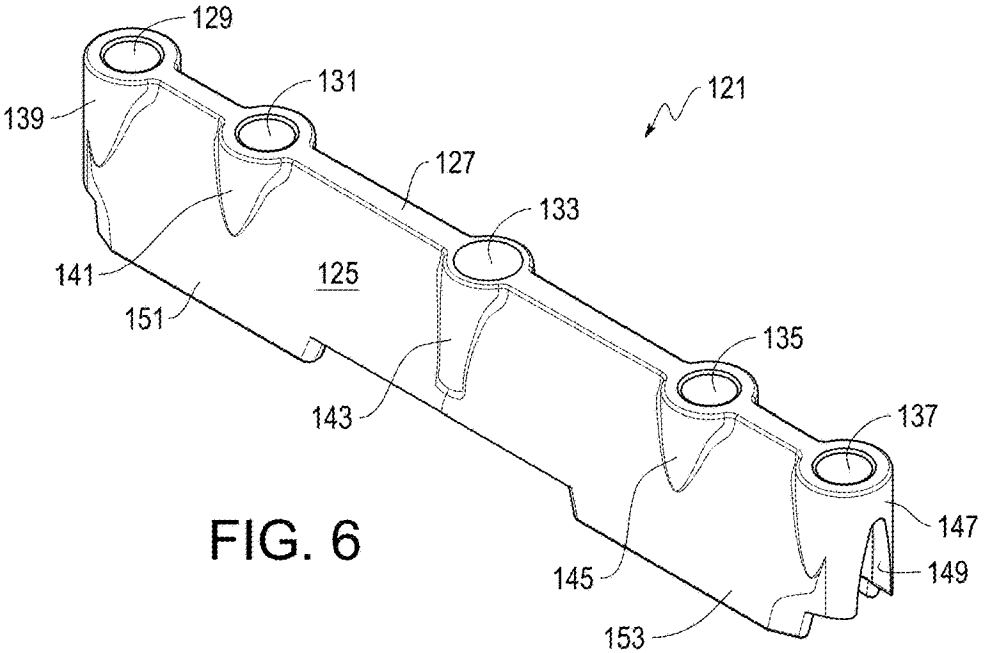
FIG. 6 is a top perspective view of an embodiment of a straight line connector that can connect two of the elongated ceiling grid member illustrated in FIGS. 1, 2 and 2A end-to-end in a straight line.
Figure 7:
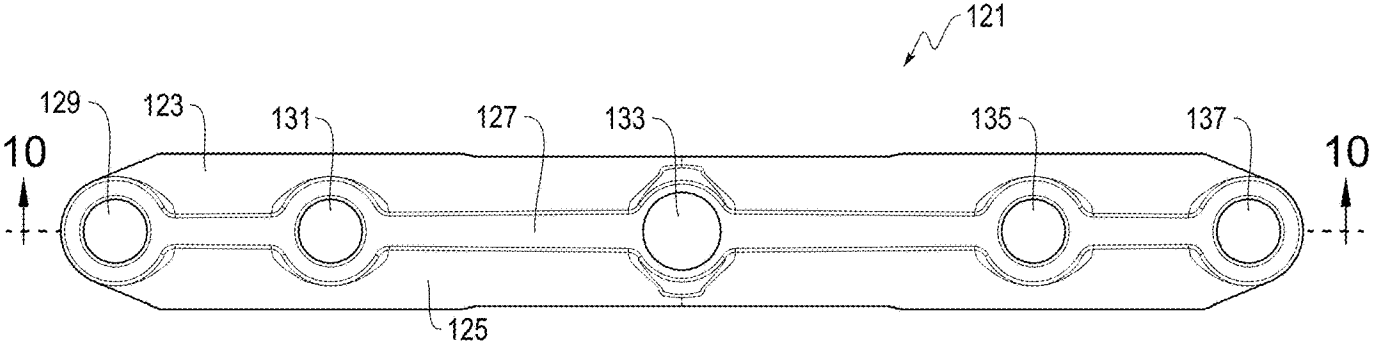
FIG. 7 is a top view of the straight line connector illustrated in FIG. 6.
Figure 8:
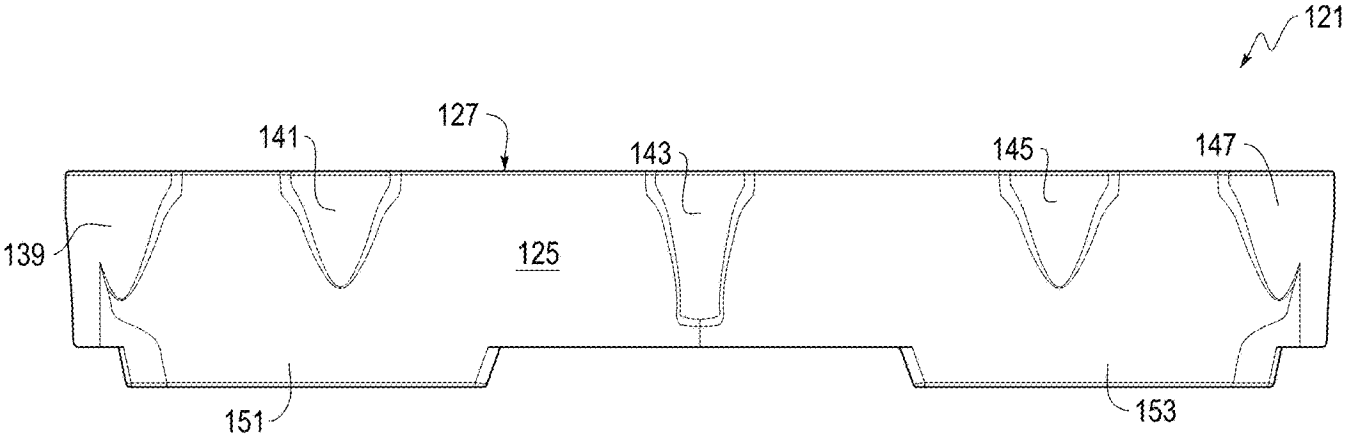
FIG. 8 is a side, elevation view of the straight line connector illustrated in FIGS. 6 and 7.
Figure 10:
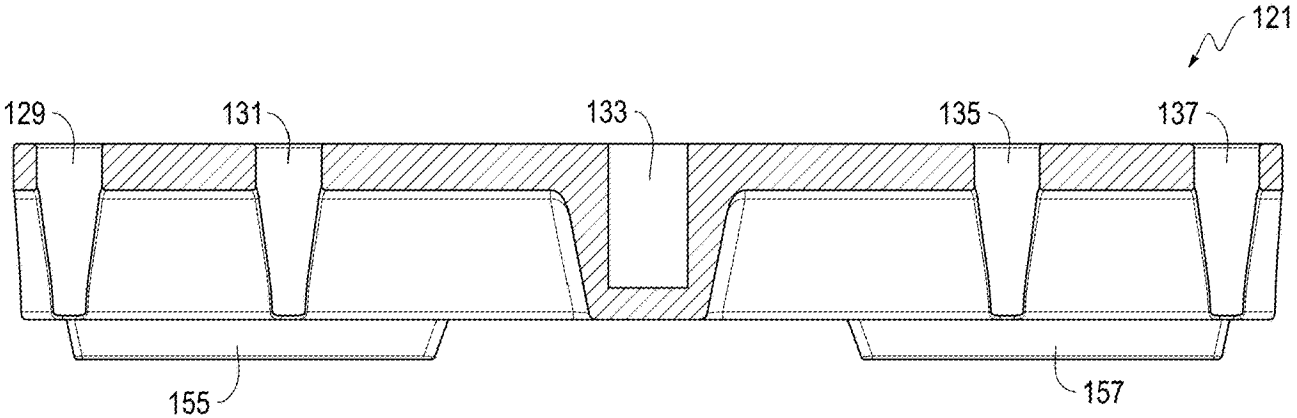
FIG. 10 is a cross-sectional view of the straight line connector illustrated in FIGS. 6-9 taken along line 10-10 of FIG. 7.

Portions of side walls 123 and 125 have different slopes than the rest of those side walls. Those differently-sloped portions form bubble portion 139 around orifice 129, bubble portion 141 around orifice 131, bubble portion 143 around orifice 133, bubble portion 145 around orifice 135 and bubble portion 147 around orifice 137, as shown in FIGS. 6 and 8. Those bubble portions provide added material around the respective orifices. That added material increases the "strength" of the bolt/orifices connections, which could be a weak point without the added material.

Figure 9:
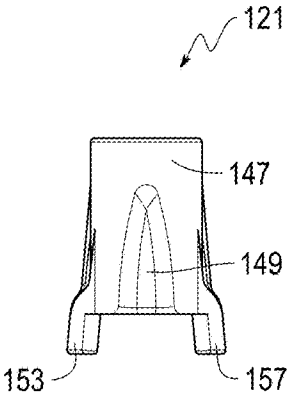
FIG. 9 is a front, elevation view of the straight line connector illustrated in FIGS. 6-8.

Bubble portion 147 includes opening 149, as illustrated in FIGS. 6 and 9. There is a similar opening in bubble portion 139 which is not illustrated in the figures. The inclusion of those openings reduces the material of straight line connector 121.

Side wall 123 includes bottom tabs 155 and 157. Side wall 125 includes bottom tabs 151 and 153.

Figure 12:
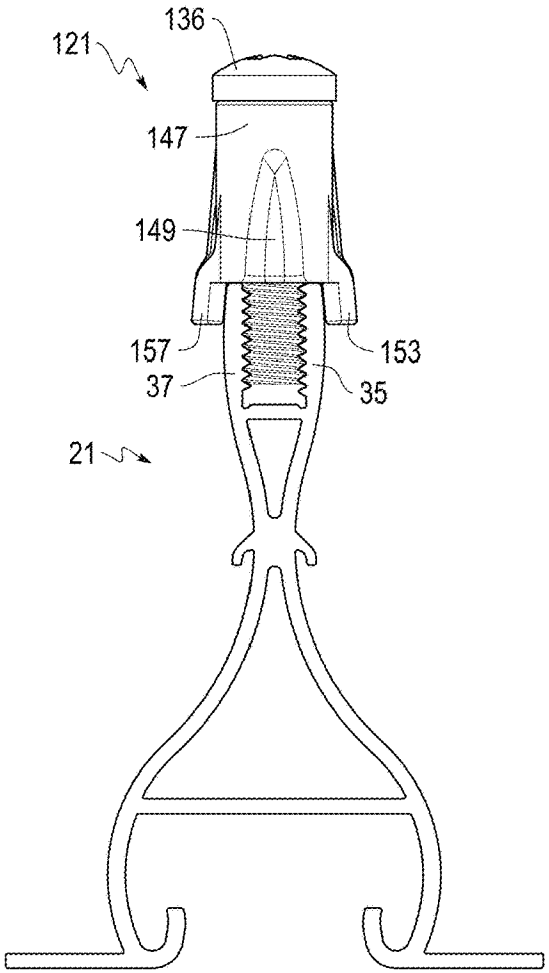
FIG. 12 is a front, elevation view of the assembly, illustrated in FIG. 11, of the straight line connector illustrated in FIGS. 7-10 attached to two of the elongated ceiling grid member illustrated in FIGS. 1, 2 and 2A.

Bottom tabs 151, 153, 155 and 157 are configured to receive upper portions 23 of the two elongated ceiling grid members 21 between them, as illustrated in FIGS. 11 and 12. The receipt of upper portions 23 between bottom tabs 151, 153, 155 and 157 resists deformation of upper portions 23 in directions perpendicular to bottom tabs 151, 153, 155 and 157 under heavy loads.

As stated, another embodiment of a connector for joining two elongated ceiling grid members 21 end-to-end, in a straight line, straight line connector 81, is illustrated in FIGS. 27-31.

Straight line connector 81 includes base wall 83 and side walls 85 and 87.

Figure 29:
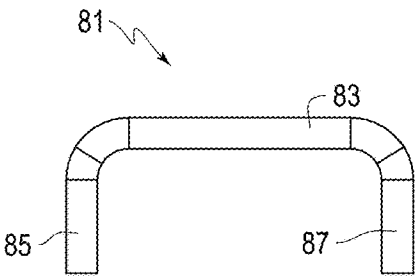
FIG. 29 is a front, elevation view of the straight line connector illustrated in FIGS. 27 and 28.

Side walls 85 and 87 extend downward from opposite edges of base wall 83, as shown, for example, in FIG. 29. Side wall 85 has teeth 89 extending downward. Side wall 87 includes similar teeth, but those teeth are not illustrated in the figures.

Figure 27:
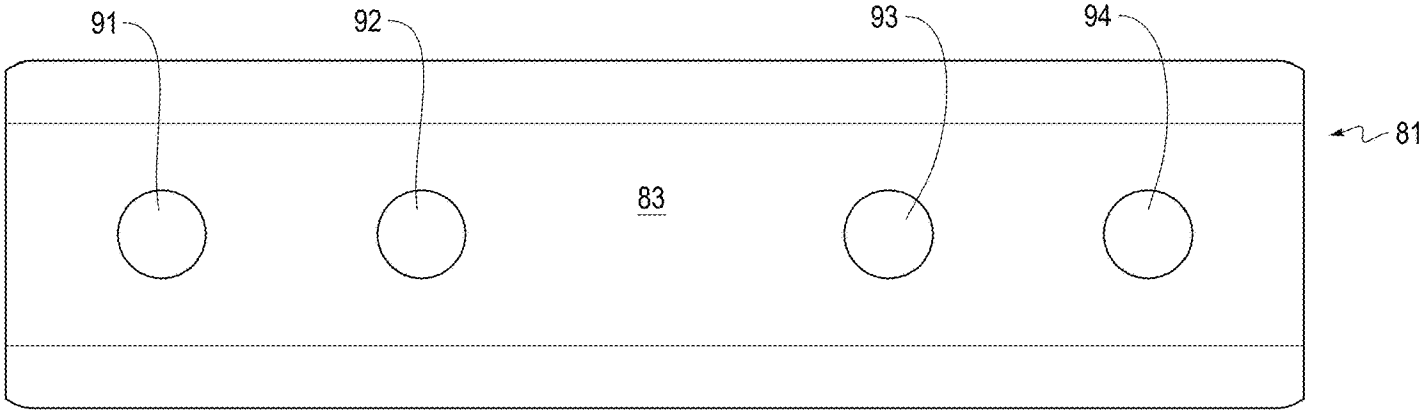
FIG. 27 is a top plan view of another straight line connector that can connect two of the elongated ceiling grid member illustrated in FIGS. 1, 2 and 2A end-to-end in a straight line.
Figure 28:
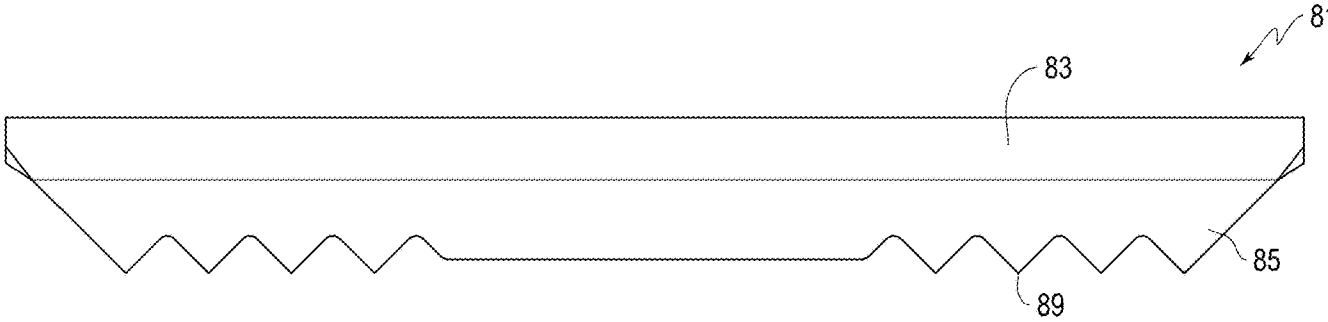
FIG. 28 is a side, elevation view of the straight line connector illustrated in FIG. 27.

Base wall 83 includes spaced, threaded holes 91-94, as illustrated in FIG. 27. The function of spaced, threaded holes 91-94 is explained below.

Straight line connector 81 can be utilized to connect two elongated ceiling grid members 21 end-to-end as follows.

Figure 30:
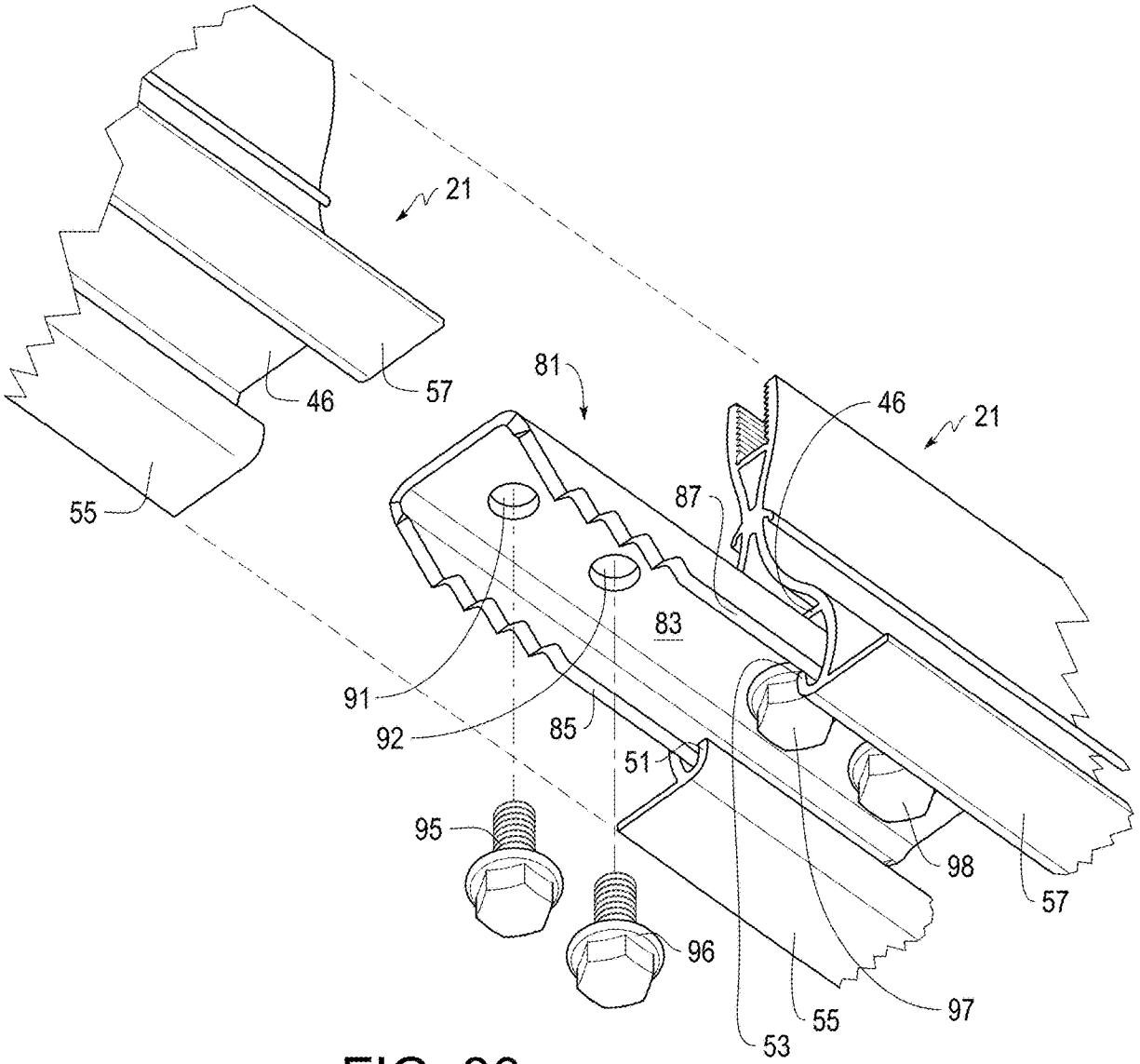
FIG. 30 is a bottom, perspective view of an assembly of the straight line connector illustrated in FIGS. 27-29 connected to two of the elongated ceiling grid member illustrated in FIGS. 1, 2 and 2A.
Figure 31:
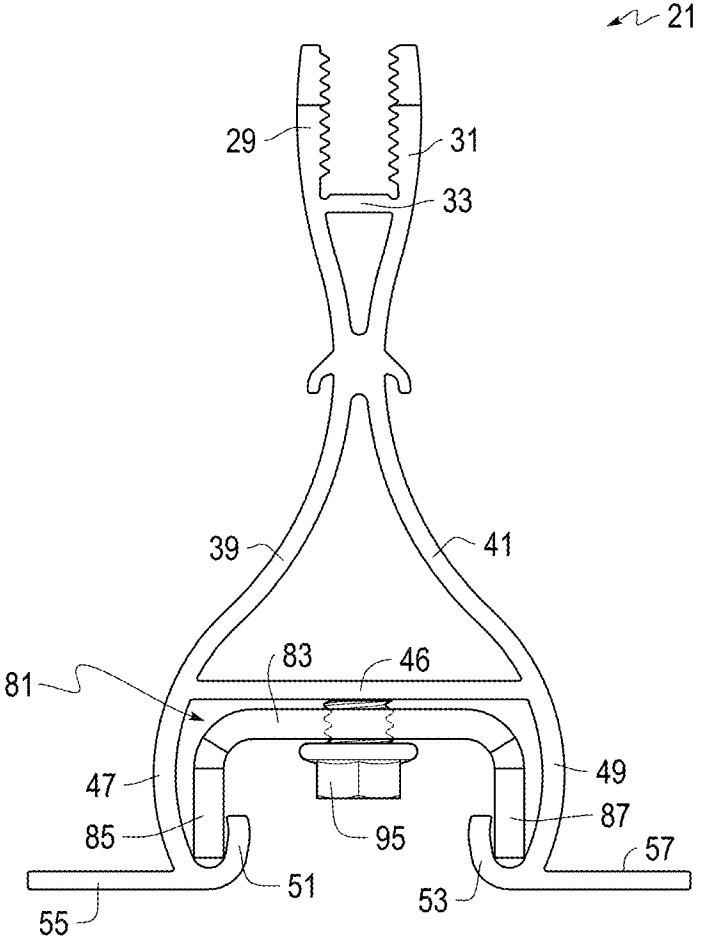
FIG. 31 is a front, elevation view of the assembly illustrated in FIG. 30.

As illustrated in FIGS. 30 and 31, straight line connector 81 is inserted in lower portions 27 of the two elongated ceiling grid members 21 such that side wall 85 of straight line connector 81 engages fingers 51 of the two elongated ceiling grid members and side wall 87 of straight line connector 81 engages fingers 53 of the two elongated ceiling grid members 21.

Bolts that threadedly engage spaced, threaded holes 91-94, such as bolts 95-98, are inserted into threaded holes 91 and 94 are tightened until the threaded ends of those bolts firmly engage the underside of top wall 46. Alternatively, top wall 46 may have threaded holes that are aligned with spaced, threaded holes 91-94 such that the threaded ends of bolts 95-98 may also engage the threaded holes in top wall 46.

Figure 20A:
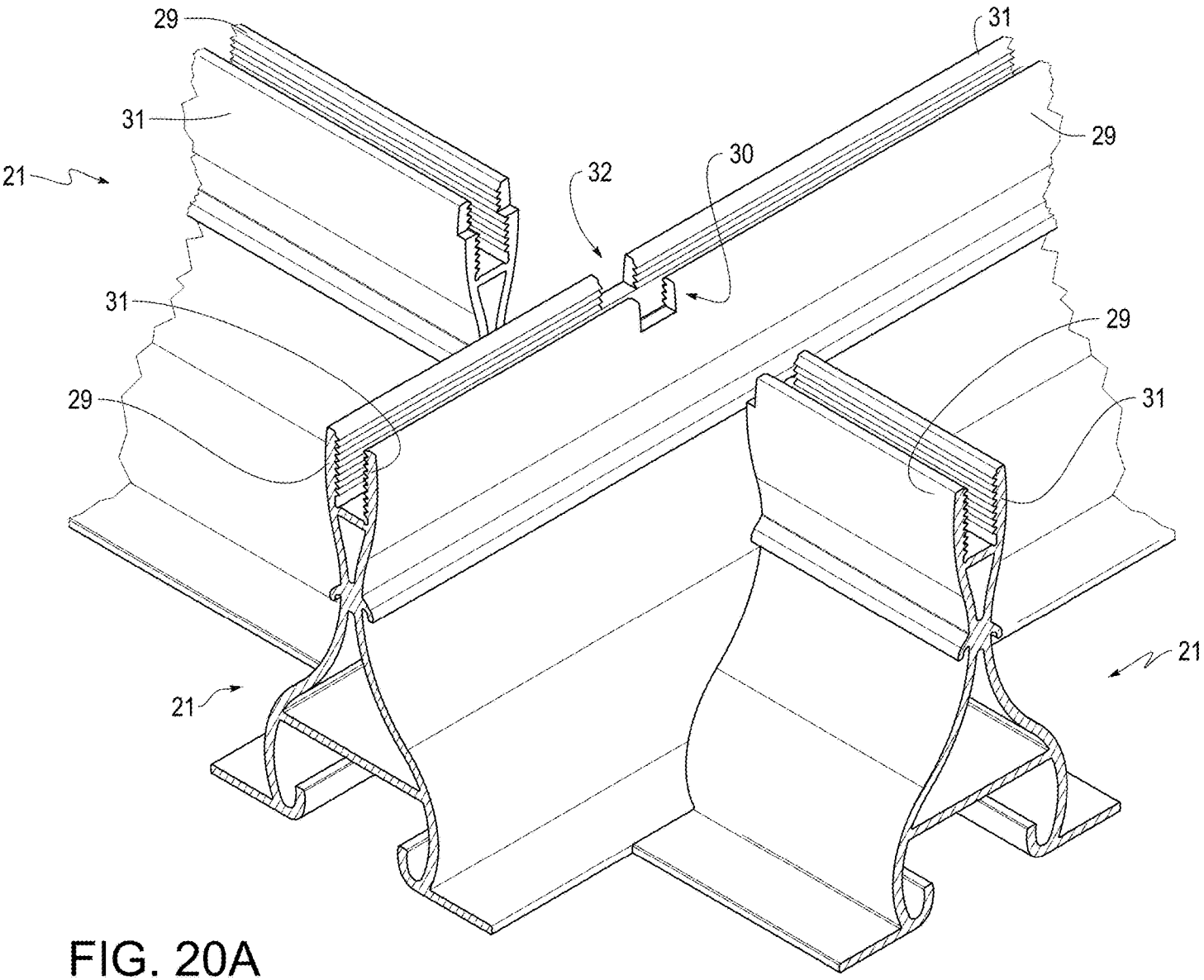
FIG. 20A is a top perspective view of three of the elongated ceiling grid member illustrated in FIGS. 1, 2 and 2A, aligned in an X formation for receipt of the four arm connector illustrated in FIGS. 13-19.
Figure 20B:
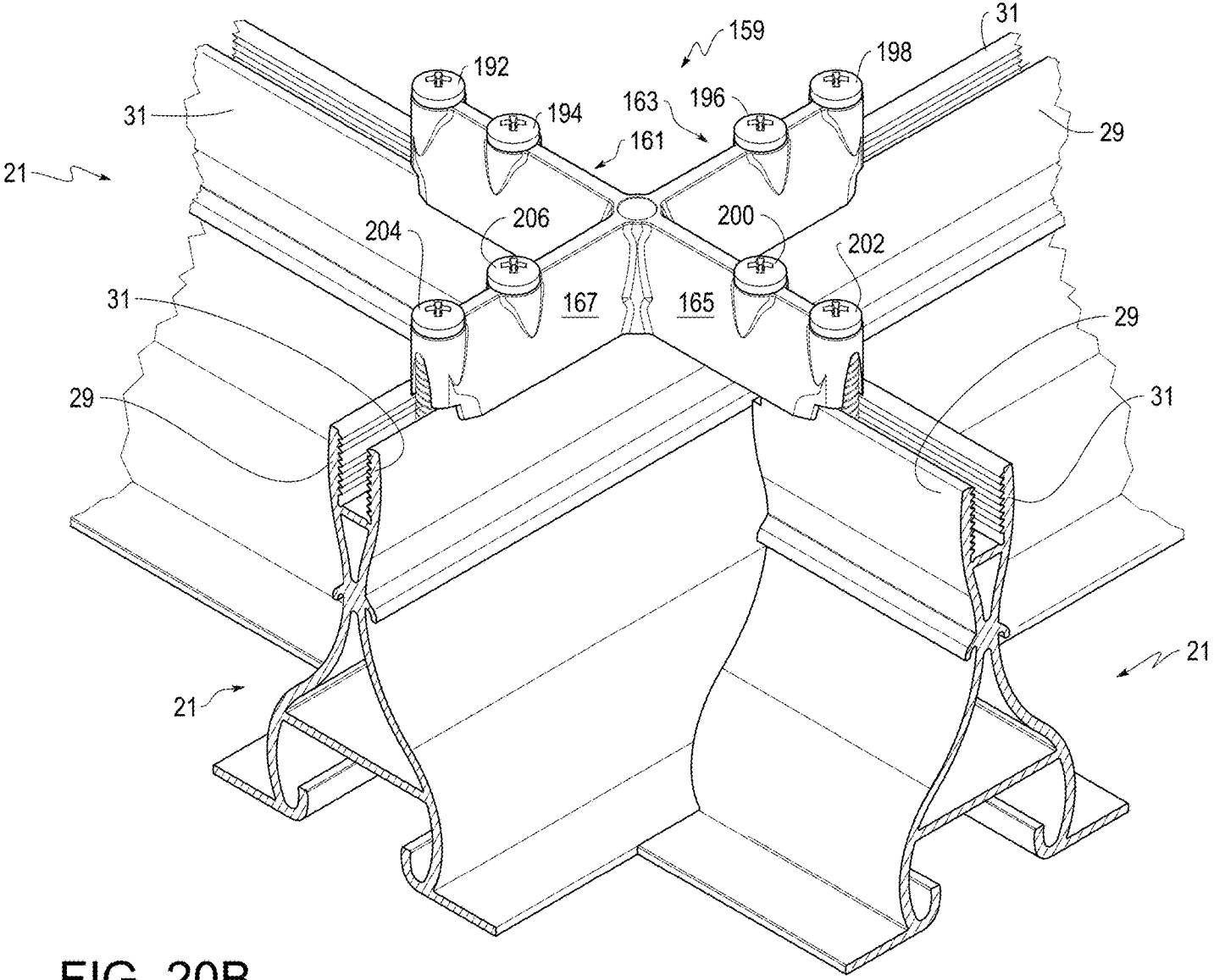
FIG. 20B is a top perspective view of the four arm connector illustrated in FIGS. 13-19 attached to three of the elongated ceiling grid member illustrated in FIGS. 1, 2 and 2A.

As stated, a four arm connector that can be utilized to connect three or four of elongated ceiling grid member 121 in an X formation is illustrated in FIGS. 13-19, 20B and 21, four arm connector 159. The arrangement of three of elongated ceiling grid member 21 in an X formation is illustrated in FIG. 20A.

Four arm connector 159 includes first arm 161, second arm 163, third arm 165, fourth arm 167 and protrusion 235. Each of arms 161, 163, 165 and 167 is the same, as discussed below.

First arm 161, second arm 163, third arm 165 and fourth arm 167 include top wall 169, which, in this embodiment of the invention, is flat and extends along the top of each of first arm 161, second arm 163, third arm 165 and fourth arm 167, as shown in the figures, and protrusion 235.

Orifices 187, 189, 190, 191, 193, 195, 197, 199 and 201 are in top wall 169. Specifically, orifices 191 and 193 are in the portion of top wall 169 in first arm 161, orifices 195 and 197 are in the portion of top wall 169 in second arm 163, orifices 199 and 201 are in the portion of top wall 169 in third arm 165, orifices 187 and 189 are in the portion of top wall 169 in fourth arm 167, and orifice 190 is in the center of arms 161, 163, 165 and 167.

Figure 21:
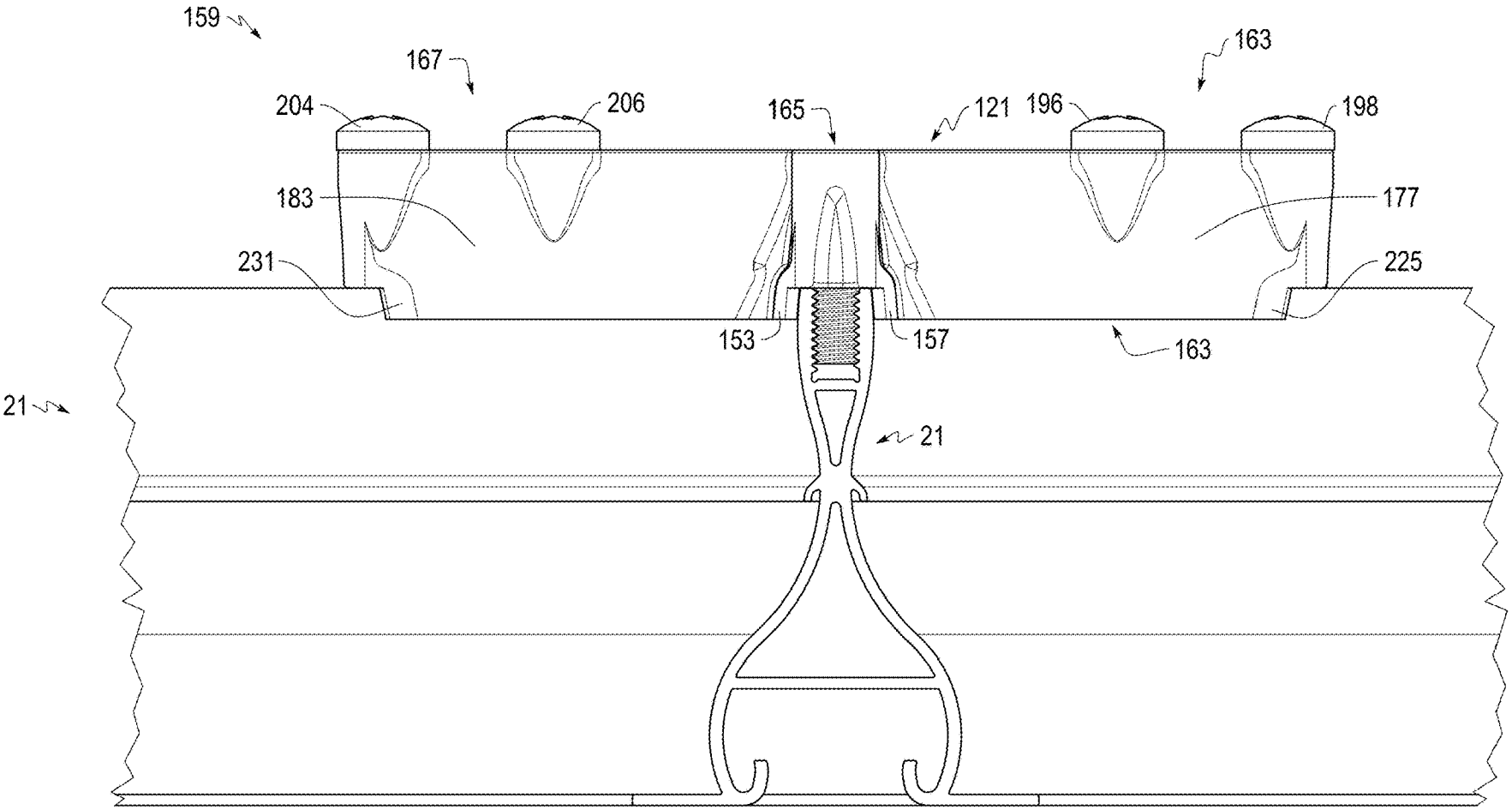
FIG. 21 is a side, elevation view of the assembly, illustrated in FIG. 20B, of the four arm connector illustrated in FIGS. 13-19 attached to three of the elongated ceiling grid member illustrated in FIGS. 1, 2 and 2A.
Figure 23:
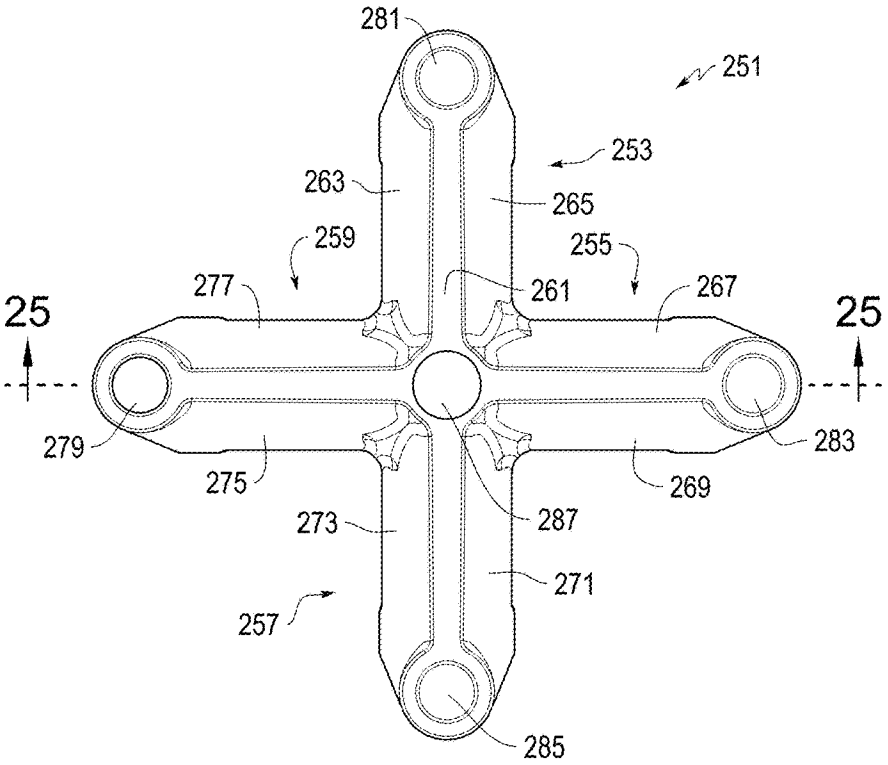
FIG. 23 is a top view of the four arm connector illustrated in FIG. 22.
Figure 22:
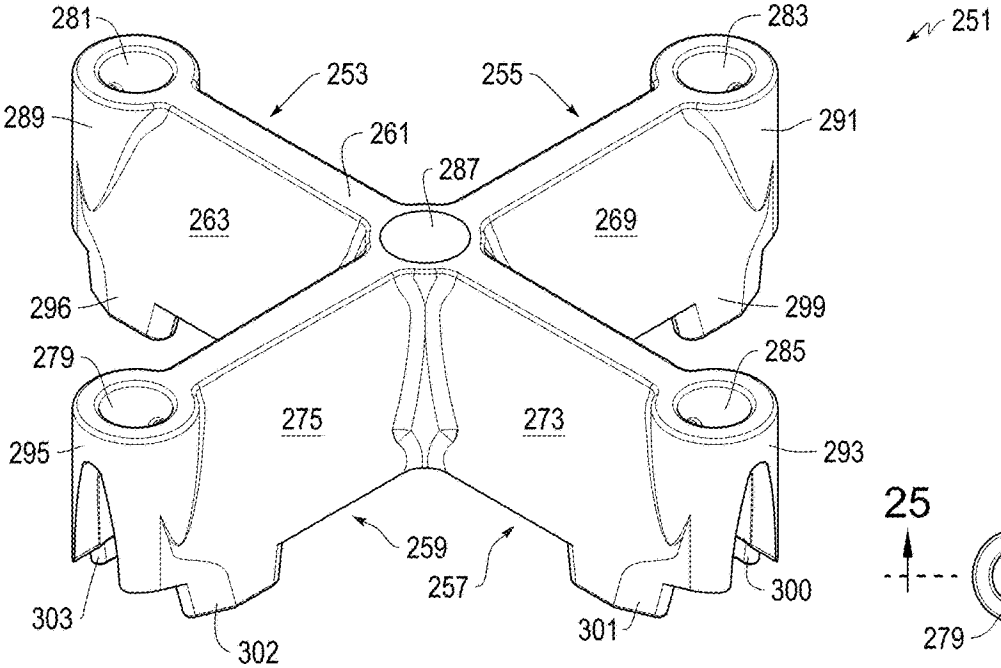
FIG. 22 is a top perspective view of another four arm connector that can connect three or four of the elongated ceiling grid member illustrated in FIGS. 1, 2 and 2A in an X formation.
Figure 26:
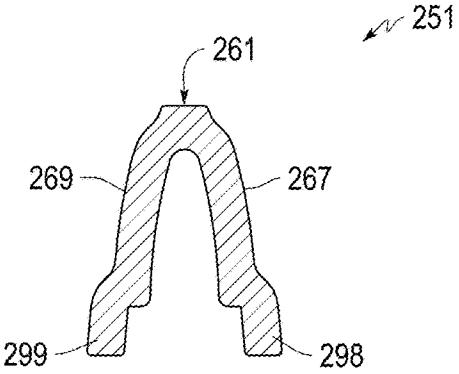
FIG. 26 is a cross sectional view of the four arm connector illustrated in FIGS. 22-25 taken along line 26-26 of FIG. 24.
Figure 24:
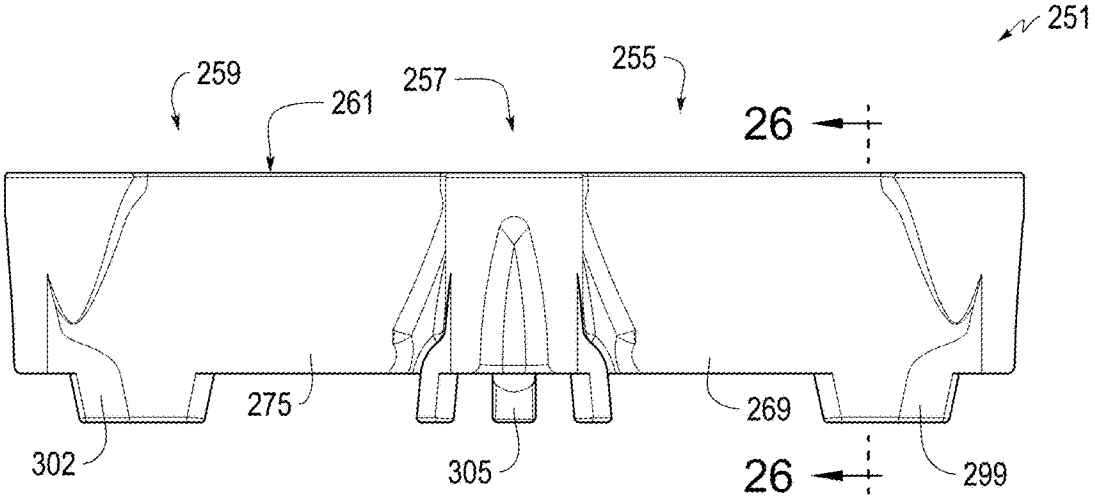
FIG. 24 is a side, elevation view of the four arm connector illustrated in FIGS. 22 and 23.
Figure 25:
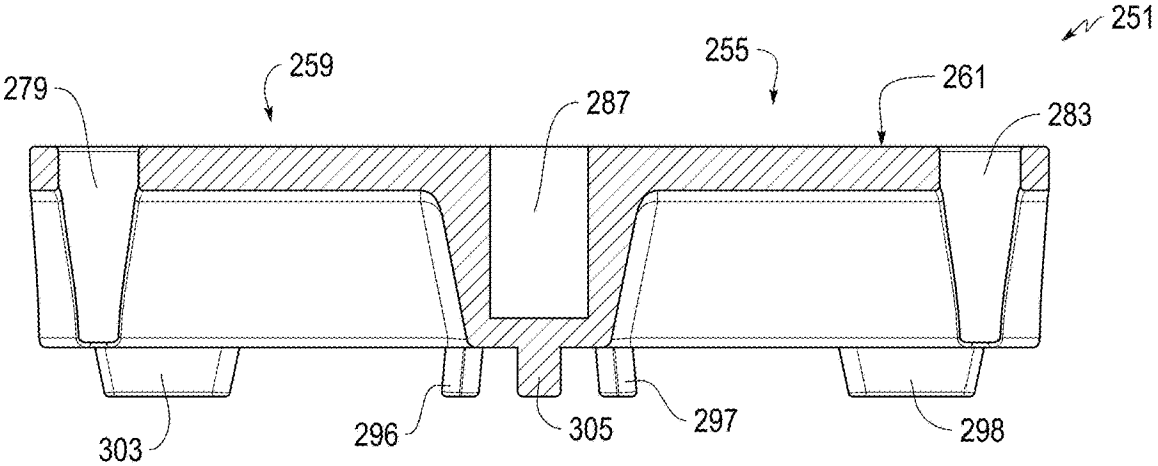
FIG. 25 is a cross-sectional view of the four arm connector illustrated in FIGS. 22-24 taken along line 25-25 of FIG. 23.

Orifices 187, 189, 191, 193, 195, 197, 199 and 201 are configured to receive bolts or other fastening members, such as bolts 192, 194, 196, 198, 200, 202, 204 and 206 illustrated in FIGS. 20 and 21, to attach four arm connector 159 to four elongated ceiling grid members 21, as illustrated in FIGS. 20 and 21. Specifically, bolts 192, 194, 196, 198, 200, 202 and 204 are inserted through orifices 187, 189, 191, 193, 197, 199 and 201 and the threaded portions of those bolts are threadably received by internal threads 35 of side wall 29 of upper portion 23 and internal threads 37 of side wall 31 of upper portion 23 of the four elongated ceiling grid members 21.

Orifice 190 is configured to be machined to receive and engage a structural member, such as a rod, suspended from ceiling structure.

Each of first arm 161, second arm 163, third arm 165 and fourth arm 167 includes side walls that extend downwardly from top wall 169. Specifically, first arm 161 includes side walls 171 and 173, second arm 163 includes side walls 175 and 177, third arm 165 includes side walls 179 and 181 and fourth arm 167 include side walls 183 and 185.

Portions of side walls 171, 173, 175, 177, 179, 181, 183 and 185 have different slopes than the rest of those side walls. Those different-sloped portions form bubble portion 203 around orifice 193, bubble portion 205 around orifice 191, bubble portion 207 around orifice 197, bubble portion 209 around orifice 195, bubble portion 211 around orifice 201, bubble portion 213 around orifice 199, bubble portion 215 around orifice 187 and bubble portion 217 around orifice 189. The same as bubble portions 139, 141, 143, 145 and 147 discussed above, bubble portions 203, 205, 207, 209, 211, 213, 215 and 217 increase the "strength"of the respective bolt/orifice connections.

Each of side walls 171, 173, 175, 177, 179, 181, 183 and 185 include a bottom tab. Specifically, side wall 171 includes bottom tab 219, side wall 173 includes bottom tab 221, side wall 175 includes bottom tab 223, side wall 177 includes bottom tab 225, side wall 179 includes bottom tab 227, side wall 121 includes bottom tab 229, side wall 183 includes bottom tab 231 and side wall 185 includes bottom tab 233.

Bottom tabs 219, 221, 223, 225, 227, 229, 231 and 233 are configured to receive upper portions 23 of elongated ceiling grid members 21 between them, as illustrated in FIGS. 20 and 21. Specifically, upper portion 23 of a first elongated ceiling grid member 21 is received between bottom tabs 219 and 221, upper portion 23 of a second elongated ceiling grid member 21 is received between bottom tabs 223 and 225, upper portion 23 of a third elongated ceiling grid member 21 is received between bottom tabs 227 and 229 and upper portion 23 of a fourth elongated ceiling grid member 21 is received between bottom tabs 231 and 233. The receipt of those upper portions 23 between the respective bottom tabs resists deformation of those upper portions under heavy loads.

Protrusion 235 extends downward from the center portion of four arm connector 159, as illustrated in FIGS. 15-18. Protrusion 235 is configured to be received in a pair of notches 30 and 32 in side walls 29 and 32 of an elongated ceiling grid member 21 when four arm connector 159 is used to connect three elongated ceiling grid members 21 in an X formation. Alternatively, protrusion 235 can be received in notches 34 and 36 of two elongated ceiling grid members 21, arranged end to end, to connect four elongated ceiling grid members 21 in an X formation.

Another four arm connector that can be used to connect three or four of elongated ceiling grid member 121 in an X formation is illustrated in FIGS. 22-25, four arm connector 251.

Similar to four arm connector 159, four arm connector 251 includes first arm 253, second arm 255, third arm 257, fourth arm 259 and protrusion 305. Each of arms 253, 255, 257 and 259 is the same, as discussed below.

First arm 253, second arm 255, third arm 257 and fourth arm 259 include top wall 261, which, in this embodiment of the invention, is flat and extends along the top of each of first arm 253, second arm 255, third arm 257 and fourth arm 259, as shown in the figures.

As shown in FIGS. 22-25, orifices 279, 281, 283, 285 and 287 are in top wall 261. Specifically, orifice 281 is in the portion of top wall 261 in first arm 253, orifice 283 is in the portion of top wall 261 in second arm 255, orifice 285 is in the portion of top wall 261 in third arm 257, orifice 279 is in the portion of top wall 261 in fourth arm 259 and orifice 287 is at the intersection of arms 253, 255, 257 and 259.

Similar to orifices 187, 189, 191, 193, 195, 197, 199 and 201 in top wall 169 of four arm connector 159, orifices 279, 281, 283 and 285 are configured to receive bolts or other fastening members to attach four arm connector 251 to four ceiling grid members 21.

Orifice 287 is configured to be machined to receive and engage a structural member, such as a rod, suspended from ceiling structure.

Each of first arm 253, second arm 255, third arm 257 and fourth arm 259 includes side walls that extend downwardly from top wall 261. Specifically, first arm 253 includes side walls 263 and 265, second arm 255 includes side walls 267 and 269, third arm 257 includes side walls 271 and 273 and fourth arm 259 includes side walls 275 and 277.

Portions of side walls 263, 265, 267, 269, 271, 273, 275 and 277 have different slopes than the rest of those side walls. Those different-sloped portions form bubble portion 289 around orifice 281, bubble portion 291 around orifice 283, bubble portion 293 around orifice 197 and bubble portion 295 around orifice 279. The same as bubble portions 139, 141, 143, 145 and 147 discussed above, bubble portions 289, 291, 293 and 295 increase the "strength"of the respective bolt/orifice connections.

Each of side walls 263, 265, 267, 269, 271, 273, 275 and 277 include a bottom tab. Specifically, side wall 263 includes bottom tab 296, side wall 265 includes bottom tab 297, side wall 267 includes bottom tab 298, side wall 269 includes bottom tab 299, side wall 271 includes bottom tab 300, side wall 273 includes bottom tab 301, side wall 275 includes bottom tab 302 and side wall 277 includes bottom tab 303.

Bottom tabs 296-303 are configured to receive upper portions 23 of elongated ceiling grid members 21 between them. Specifically, upper portion 23 of a first elongated ceiling grid member 21 is received between bottom tabs 296 and 297, upper portion 23 of a second elongated ceiling grid member 21 is received between bottom tabs 298 and 299, upper portion 23 of a third elongated ceiling grid member 21 is received between bottom tabs 300 and 301 and upper portion 23 of a fourth elongated ceiling grid member 21 is received between bottom tabs 302 and 303. The receipt of those upper portions 23 between the respective bottom tabs resists deformation of those upper portions under heavy loads.

Protrusion 305 can be utilized the same as protrusion 235 of four arm connector 159.

What is described and illustrated herein are preferred embodiments of the invention with some variations. The terms, descriptions and figures are for description and illustration of those preferred embodiments only and are not meant as limitations on the scope of this invention. Those skilled in the art will recognize that many different embodiments and variations beyond the specifically disclosed embodiments and variations are within the scope of the invention, as defined by the following claims.

What is claimed is:

1. An elongated ceiling grid member having a longitudinal axis in a longitudinal direction and comprising:

an upper portion having spaced upper portion side walls (a) extending in parallel in the longitudinal direction, (b) threaded to threadably receive and retain a first threaded member and (c) including lowermost edges extending in the longitudinal direction;

a lower portion having spaced lower portion side walls (a) extending in the longitudinal direction, (b) configured to receive and retain a second threaded member and (c) including uppermost edges extending in the longitudinal direction; and a middle portion that (a) connects the lowermost edges of the upper portion side walls and the uppermost edges of the lower portion side walls and (b) includes a pair of middle portion side walls extending in the longitudinal direction, wherein:

each of the pair of middle portion side walls, from top to bottom when viewed along the longitudinal axis, (a) begins at or near a different one of the lowermost edges of the upper portion side walls, (b) curves toward another of the pair of middle portion side walls to join the another of the pair of middle portion side walls and (c) curves away from the another of the pair of middle portion side walls from joinder with the another of the pair of middle portion side walls to end at or near one of the uppermost edges of the lower portion side walls; and the each of the pair of middle portion side walls is continuously curved.

2. The elongated ceiling grid member according to claim 1, wherein:

the upper portion includes a bottom wall that extends between and connects the upper portion side walls at or near the lowermost edges;

the lower portion includes a top wall that extends between and connects the lower portion side walls at or near the uppermost edges; and the middle portion side walls begin at the bottom wall and end at the top wall.

3. The elongated ceiling grid member according to claim 1, wherein each of the upper portion side walls includes internal threads.

4. The elongated ceiling grid member according to claim 1, wherein the lower portion includes (i) lowermost flanges (a) extending in the longitudinal direction from and perpendicular to the pair of lower portion side walls and (b) configured to support a ceiling tile and (ii) upwardly extending fingers (a) extending inwardly from the pair of lower portion side walls and (b) configured to engage and retain a channel nut.

5. The elongated ceiling grid member according to claim 1, wherein each of the pair of middle portion side walls includes a finger configured to engage a ceiling tile hold down clip.

6. The elongated ceiling grid member according to claim 5, wherein each of the finger extends outwardly from the pair of middle portion side walls.

7. An elongated ceiling grid member and ceiling tile hold down clip assembly comprising:

the elongated ceiling grid member according to claim 5 and including lowermost flanges (a) extending in the longitudinal direction from and perpendicular to the pair of lower portion side walls and (b) configured to support a ceiling tile; and a ceiling tile hold down clip (a) in engagement with the each of the finger and (b) configured to engage the ceiling tile supported by the lowermost flanges.

8. The elongated ceiling grid member and ceiling tile hold down clip assembly according to claim 7, wherein the ceiling tile hold down clip includes:

a ceiling tile hold down clip top wall above and spanning the upper portion side walls;

ceiling tile hold down clip side walls (i) extending downward from the ceiling hold down clip top wall and (ii) abutting exterior surfaces of the upper portion side walls;

outwardly extending walls that extend outwardly and downwardly from the ceiling tile hold down clip side walls; and a ceiling tile hold down clip finger that extends inwardly from the outwardly extending walls and engages the finger of the middle portion.

9. The elongated ceiling grid member and ceiling tile hold down clip assembly according to claim 8, wherein the ceiling tile hold down clip includes bottom flanges that (a) extend outwardly from the outwardly extending walls and (b) are configured to engage the ceiling tile.

10. The elongated ceiling grid member and ceiling tile hold down clip assembly according to claim 8, wherein the ceiling tile hold down clip is comprised of a spring steel.

11. An elongated ceiling grid member and connector assembly comprising:

at least two of the elongated ceiling grid member according to claim 1; and a connector (a) bridging two of the at least two elongated ceiling grid member, (b) having a connector top wall with at least two orifices configured to receive the first threaded member, (c) having connector side walls extending downward from the connector top wall toward the upper portion side walls, and (d) having tabs (i) extending from the connector side walls on both sides of the upper portion side walls and (ii) configured to engage and retain the upper portion side walls, wherein:

there is a first lateral distance between the connector side walls and a second lateral distance between the tabs; and the second lateral distance is greater than the first lateral distance.

12. The elongated ceiling grid member and connector assembly according to claim 11, wherein the connector top wall includes a central orifice configured to receive and retain a support from a ceiling.

13. The elongated ceiling grid member and connector assembly according to claim 11, wherein:

the at least two of the elongated ceiling grid member are aligned in a straight line; and the at least two orifices are aligned in the straight line.

14. The elongated ceiling grid member and connector assembly according to claim 11, wherein:

the at least two of the elongated ceiling grid member includes a first pair and a third one of the at least two elongated ceiling grid member;

the first pair is aligned in a first direction;

the third one is aligned in a second direction;

the second direction is perpendicular to the first direction;

the connector top wall covers the first pair and the third one; and the at least two orifices include an orifice above each of the first pair and the third one of the at least two elongated ceiling grid member.

* * * * *